US006616198B2

(12) United States Patent
Kitazawa

(10) Patent No.: US 6,616,198 B2
(45) Date of Patent: Sep. 9, 2003

(54) METHOD AND APPARATUS FOR TYING THREADS

(75) Inventor: Hiroshi Kitazawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/911,572

(22) Filed: Jul. 25, 2001

(65) Prior Publication Data

US 2002/0035954 A1 Mar. 28, 2002

(30) Foreign Application Priority Data

Jul. 28, 2000 (JP) ..... 2000-228584

(51) Int. Cl.[7] ..... D03J 1/16
(52) U.S. Cl. ..... 289/3; 289/1.2; 289/1.5
(58) Field of Search ..... 289/1.2, 1.5, 2, 289/3, 18.1; 66/1 A, 1 R; 87/12, 53

(56) References Cited

U.S. PATENT DOCUMENTS 1,815,546 A * 7/1931 Brownlee ..... 289/3
3,995,898 A * 12/1976 Momoi ..... 289/1.5
4,139,225 A * 2/1979 Maruyama et al. ..... 289/1.5
4,226,165 A * 10/1980 Maruyama et al. ..... 289/1.2
4,445,417 A * 5/1984 Iijima et al. ..... 289/1.5
4,711,476 A * 12/1987 Hanson ..... 289/1.2
4,774,870 A * 10/1988 Yamamoto et al. ..... 289/1.5
4,984,436 A * 1/1991 Nurk ..... 289/3

FOREIGN PATENT DOCUMENTS

JP 53-18612 6/1978
JP 54-31544 10/1979

OTHER PUBLICATIONS

Clifford W. Ashley, The Ashley Book of Knots, 1993, Doubleday, pp 78–79, knot #489.*
The Ashley Book of Knots, by Clifford W. Ashley, Revised 1993, Chapter 18, pp 257–274.*

* cited by examiner

*Primary Examiner*—Gary L. Welch
(74) *Attorney, Agent, or Firm*—Oliff & Berridge, PLC

(57) ABSTRACT

With a first thread being held at its tail end, a first loop is made. The first thread is passed through the first loop and a second loop is made thereinto. A beginning end of a second thread is inserted into the second loop, and the second loop is pulled into the first loop, and the beginning end of the second thread is tied in the first loop of the first thread.

14 Claims, 46 Drawing Sheets

58
52
21a
55a
5
19
59
16
51
1a
17
13a
13
73(74)
18
108
109
107
105
104
106
103
61a
24
61
60
12
74
22
21
73

A
B
1a
1b
5
12
13
14
15
15a
15b
15c
16
17
19
21b
23
24
32
33a
51
53
59
60
61
61a
66
69
71

1b
12
5
61
61a
66
1a

16
AX
12
52
24
1a
61a
110

5
52
16
51
110
13

16
61a
110
12

1b
5
12
5
66
1a

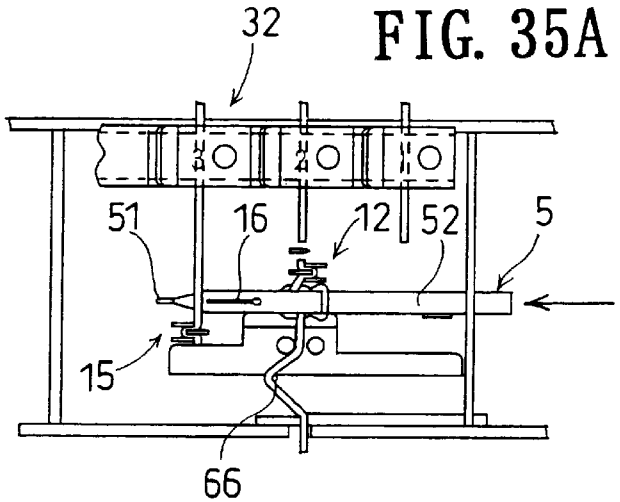
FIG. 35A
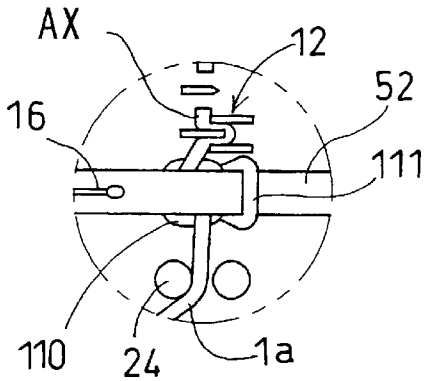
FIG. 35B
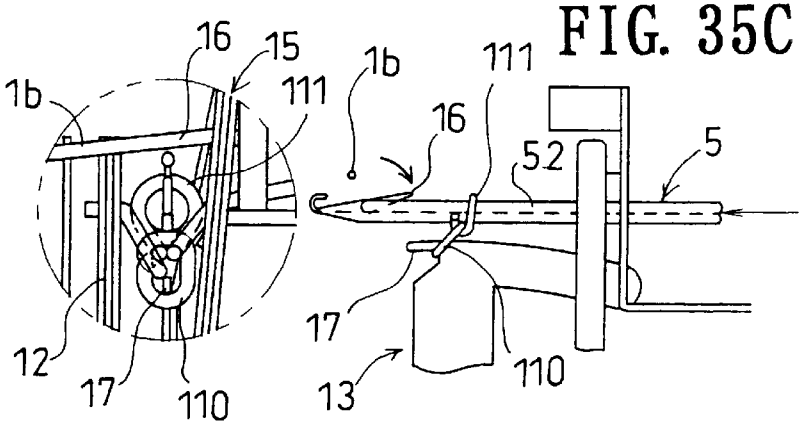
FIG. 35C
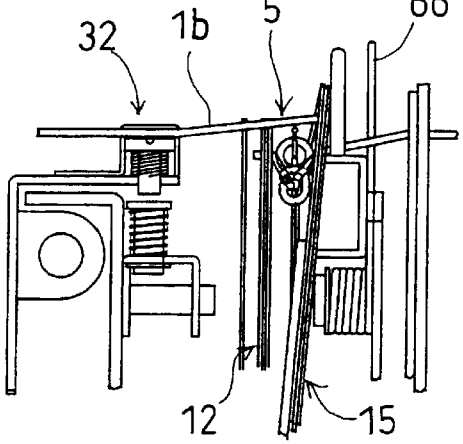
FIG. 35D
FIG. 35E

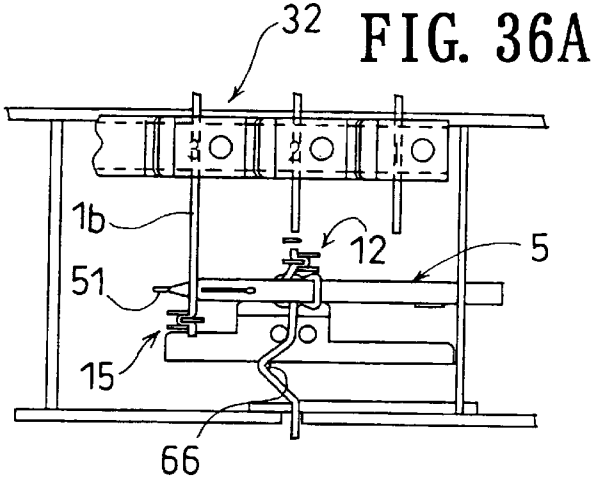
FIG. 36A
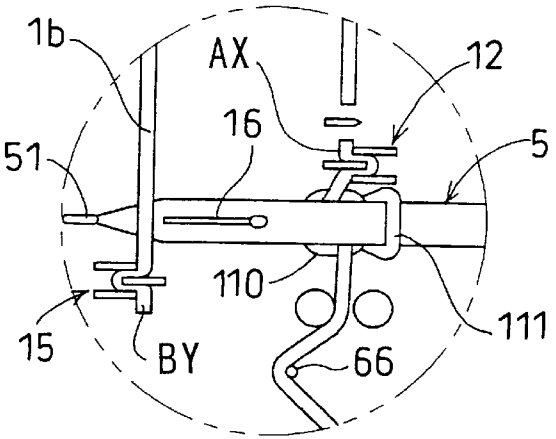
FIG. 36B
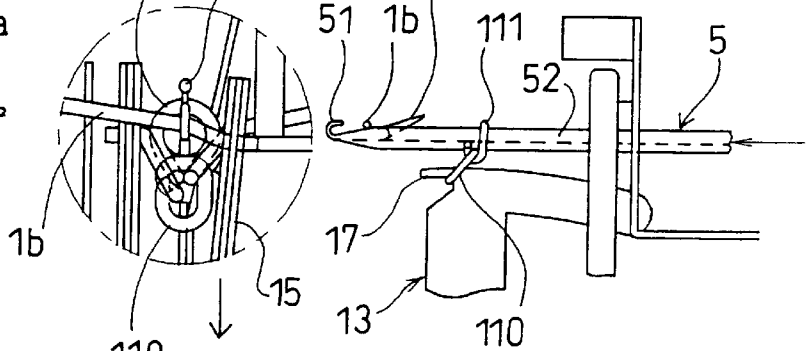
FIG. 36C
FIG. 36D
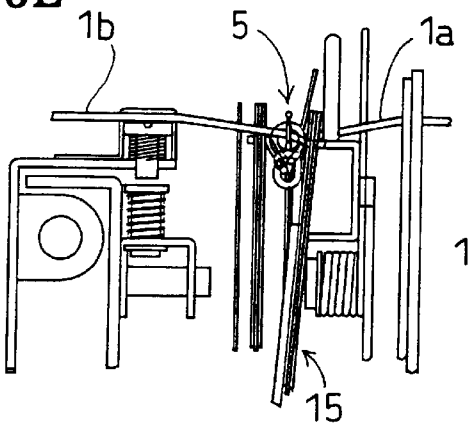
FIG. 36E

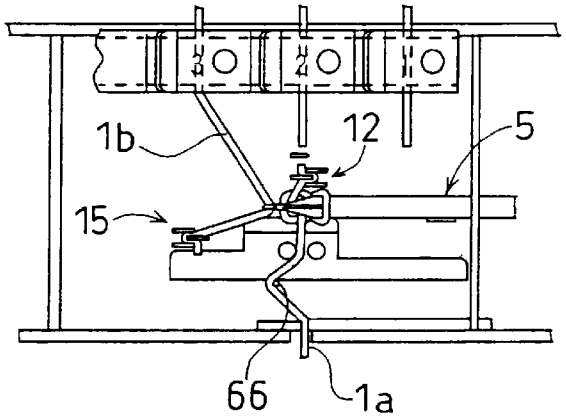
FIG. 37A
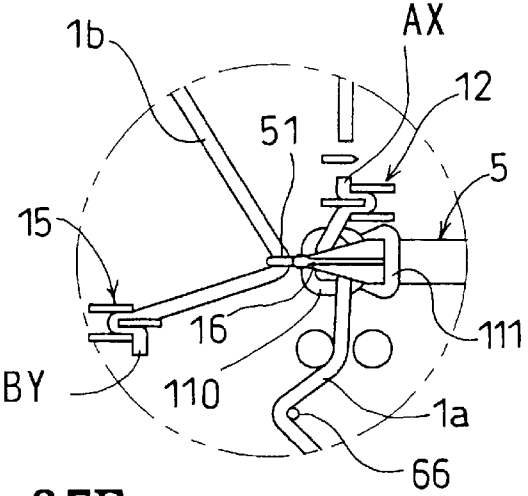
FIG. 37B
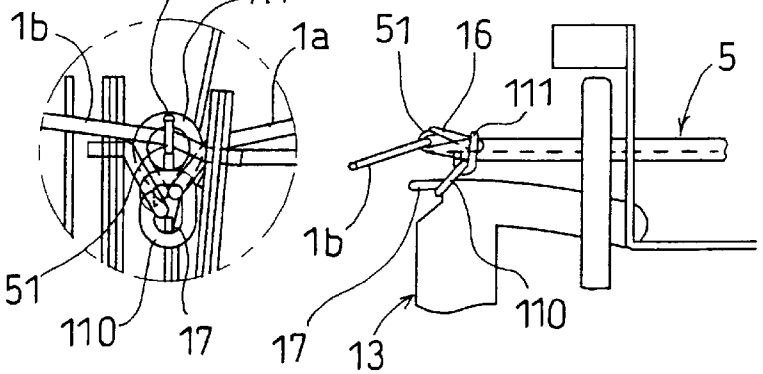
FIG. 37C
FIG. 37D
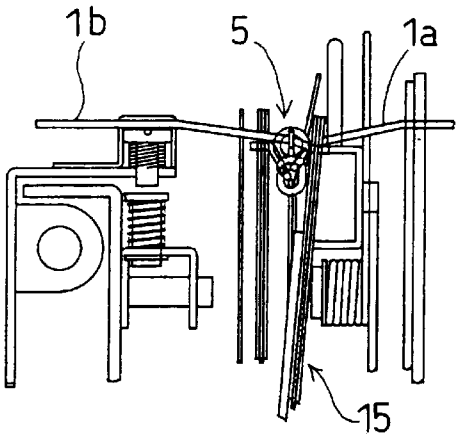
FIG. 37E 32
12
5
110
1a
66
51
1b
15

AX
5
111
66
51
110
1a
1b
BY 5
111
16
110
51
1b
17
13

111
15
117
5
110
12

15
5
12
116
32
114
1b
117
36

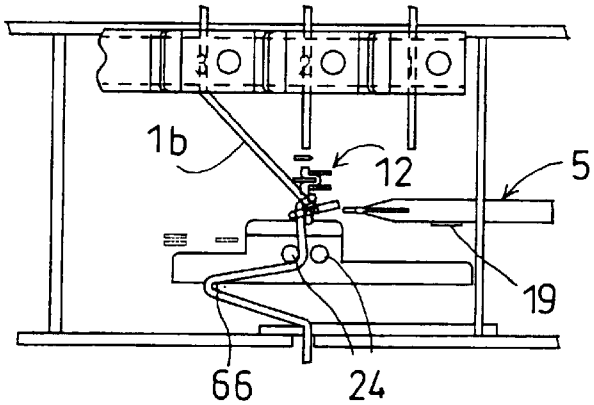
FIG. 41A
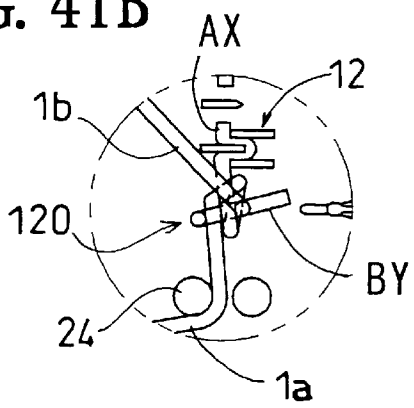
FIG. 41B
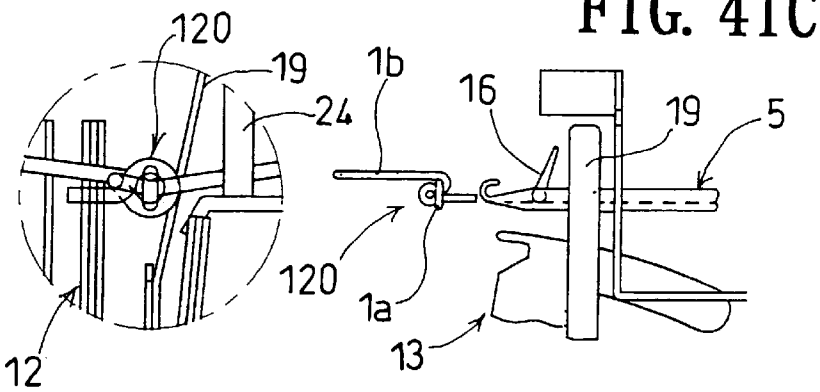
FIG. 41C
FIG. 41D
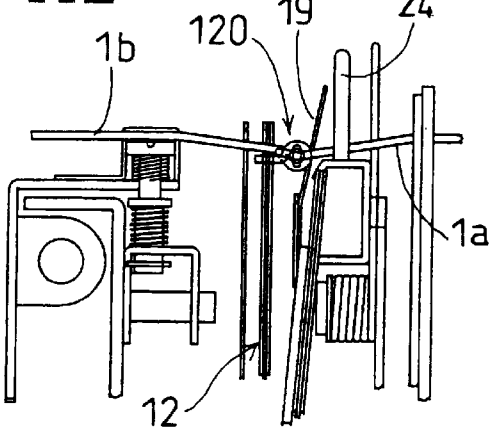
FIG. 41E

METHOD AND APPARATUS FOR TYING THREADS

BACKGROUND OF THE INVENTION

1. Field of Invention

The invention relates to a thread tying method and a thread tying apparatus which are used in various textile machines, such as a weaving machine, a knitting machine, a thread winding machine, and an embroidery machine.

2. Description of Related Art

Conventionally, various thread tying apparatuses for tying two threads at their ends have been developed. For example, Japanese Patent Publication No. 54-31544 discloses an apparatus for tying two threads at their ends using an overhand knot. In this apparatus, the thread ends are pneumatically sucked into a thread introducing pipe. The pipe includes first and second hooks required for thread tying therein. The first hook is attached to a ring, which is rotatable and vertically movable, and the second hook is disposed in a loop formation cylinder, which is disposed in the inside diameter of the ring, so as to be vertically movable. A thread catching portion is provided on a part of an upper end of the loop formation cylinder. A pair of thread guides in front of and behind the ring and a pair of chucking units outside the thread guides are disposed in a line. A tightening lever is disposed between the thread guide and the chucking unit, which are at the side where the threads enter. A thread cutter is disposed outside the other chucking unit, and a pair of U-rings for pulling threads are positioned to have the other elements placed therebetween.

In the above structure, the sucked thread ends pass through the U-rings. When the U-rings are moved downward, both thread ends are held in a line by the chucking units placed therebetween, and pulled into the first hook by way of the thread guides on both sides, and supported by the chucking units. After any unnecessary portion is cut from each thread end by a thread cutting unit, the thread ends pulled into the first hook are wound around the loop formation cylinder upon the rotation of the ring and the upward movement of the first hook. After the thread ends, caught in the first hook, pass the thread catching portion, the second hook is moved up to catch the thread ends, and moved down. Relatively, the thread release lever is moved upward to remove the thread ends from the front chucking unit. When the thread ends are released, the thread tightening lever is moved downward to tighten a loop at the thread catching portion, thereby forming a knot. However, this knot becomes untied easily.

On the other hand, in a weaver's knot formation method disclosed in Japanese Patent Publication No. 53-18612, a first thread currently used and a second thread, which remain disposed in parallel to each other under a tense condition, are tied at their middle portions. However, in a case where thread change (thread color change) is performed on an embroidery machine, the trail end of the first thread and the beginning end of the second thread are released, and it is impossible to tie the threads at their ends with this technique.

SUMMARY OF THE INVENTION

The invention provides a method and an apparatus for tying threads by a weaver's knot, which ensures firm tightening.

According to an aspect of the invention, in a method for tying a first thread and a second thread, a first loop and a second loop are made from the first thread with a tail end thereof being held, a beginning end of the second thread is inserted into the second loop, and the first loop is reduced to tie the first thread and the second thread. With this method, a weaver's knot can be made easily and simply.

According to another aspect of the invention, the method may include the following steps: making the first loop from the first thread with the tail end thereof being held using the latch needle having the hook and the latch; making the second loop from the first loop; and reducing the first loop while inserting the beginning end of the second thread into the second loop, to form the weaver's knot. In such a manner, the use of the latch needle can simplify a thread tying.

According to a further aspect of the invention, a thread tying apparatus may include a first thread holding member that holds a tail end portion of a first thread, a latch needle having a hook at a tip thereof and a latch whose root is pivotally mounted to a stem thereof so as to open and close the latch with respect to the hook, a first loop controller that slidably makes contact with the stem of the latch needle and moves in a direction of an axis of the latch needle, a second thread holding member that holds a beginning end of a second thread and changes a position of the beginning end of the second thread so as to be close to the hook of the latch needle, and an interlock mechanism that performs the following steps: rotating the latch needle on the axis thereof to make a first loop at the hook by winding the first thread substantially around the hook; advancing the latch needle to place the first loop over the latch of the latch needle, which is away from the hook, on the stem of the latch needle and to place a portion extending from the first loop of the first thread inside the latch; moving the first loop controller and the latch needle relative to each other to make the first loop go over the hook, passing the portion extending from the first loop through the first loop, making a second loop at the hook, and making the second loop go over the latch to move the second loop toward the stem of the latch needle; bring the second thread whose beginning end is held at the second thread holding member to the hook; operating the latch needle and the first loop controller together to move the second loop away from the hook and insert the second thread into the second loop; and reducing the second loop and the first loop until the beginning end of the second thread is stopped into the first loop. In this arrangement, the interlock mechanism activates the latch needle, the first thread holding member, the second thread holding member, and the first loop controller respectively in predetermined times, which ensures a thread tying.

According to another aspect of the invention, the apparatus may further include a magnet so as to separate the latch from the hook only when the latch needle comes to a rotated position. As the magnet allows the latch, which is universally pivotable and whose position is unstable, to open when the latch needle is rotated and the latch approaches the magnet, and to keep its position stable, the formation of the first loop can be ensured.

According to a further aspect of the invention, in the thread tying apparatus, the latch may be made of magnetic material so as to open away from the hook when it comes to the rotated position. The adoption of such a material can simplify the structure of the latch.

According to another aspect of the invention, in the apparatus, when the interlock mechanism disposes a portion extending to the first loop of the first thread inside the latch which is open, it places the latch away from an intersecting portion of the first loop, moves the latch needle backward with the latch being kept open by a latch regulating member until a tip of the latch passes the portion extending to the first loop, and rotates the latch needle so that the latch comes close to the intersecting portion of the first loop. This ensures the formation of the second loop.

According to a further aspect of the invention, in the apparatus, a guiding groove is formed on the stem of the latch needle along the axis of the latch needle so that a tip of the first loop controller that moves forward along the guiding groove goes into the first loop. With this structure, when the second loop is made from the first loop, a thread length required to keep a diameter of the first loop can be secured and the first loop is not moved along with back and forth movement of the latch needle. As a result, a thread tying can be performed in place.

According to another aspect of the invention, the apparatus may further include a thread volume controller that secures a thread length required for forming the first loop and the second loop from the first thread and that pulls a midpoint of the first thread to reduce a diameter of the second loop formed at the hook. Even when the tail end of the first thread is held by the first thread holding member, the required thread length can be secured simply, and the second thread to be tied to the first thread can be brought into the second loop without fail.

According to a further aspect of the invention, in the apparatus, the interlock mechanism activates the first thread holding member and the second thread holding member so as to hold and release each end portion of the first thread and the second thread, and the interlock mechanism controls the first thread holding member, the second thread holding member, and the hook such that a relative position between the first thread holding member and the hook is selectively changed between a position where the first thread is supplied and a position where the first thread is not supplied, and such that a relative position between the second thread holding member and the hook is selectively changed between a position where the second thread is supplied and a position where the second thread is not supplied. In this structure, when the latch needle is moved in a direction where the latch needle intersects an axis of each of the threads, the threads can be brought close to the hook and the latch of the latch needle to be involved in the thread tying operation only when necessary.

According to a further aspect of the invention, in the apparatus, the interlock mechanism activates the second thread holding member so as to place the second thread within a path where the latch is rotated before the second loop is moved away from the latch toward the stem of the latch needle. Although the latch is apt to move out of place, this allows the second thread to move to the hook before the latch is closed, and allows the hook of the latch needle to catch the second thread when the second loop comes off the hook.

According to a further aspect of the invention, in the apparatus, the interlock mechanism performs the following steps: advancing the latch needle to move the second loop over the latch toward the stem of the latch needle; making the hook catch the second thread whose beginning end is held at the second thread holding member; moving the latch needle backward to close the latch by the second loop; releasing the beginning of the second thread from the second thread holding member; inserting the second thread into the second loop coming off the hook; and reducing the second loop and the first loop until the beginning end of the second thread is stopped into the first loop, to tie the first thread and the second thread. In this structure, the second thread is released after the latch, which is open, is closed by the second loop to be formed into a weaver's knot. The closing of the latch can prevent the second thread from coming off the hook, thereby ensuring the insertion of the second thread into the second loop, and realizing that the first loop and the beginning end of the second thread are tied at the second loop which is to take the shape of straight line later.

According to another aspect of the invention, in the apparatus, the beginning end of the second thread is inserted into the second loop coming off the latch needle and held by the second thread pressing device. This can reliably prevent the beginning end of the second thread from coming off the second loop at the final step of thread tying.

According to a further aspect of the invention, in the apparatus, the first thread holding member includes a pair of outside plates, and an inner plate, which is capable of entering between the pair of outside plates, the pair of outside plates and the inner plate are structured to hold the first thread firmly between them, a cutter is disposed which slidably makes contact with one of the pair of outside plates, and the one of the pair of outside plates includes a control part that prevents displacement of the first thread. In such a structure, the tail end portion of the first thread can be firmly held with a short length. When the first thread is cut between the one of the pair of outside plates and the cutter, the displacement of the first thread can be prevented.

BRIEF DESCRIPTION OF THE DRAWINGS

The invention will be described in greater detail with reference to preferred embodiments thereof and the accompanying drawings wherein;

FIG. 35A is a plan view showing the second loop is over the hook for tying the second thread to the first thread (second phase);

FIG. 35B is an enlarged plan view showing the first loop and the second loop at the stem of the latch needle;

FIG. 35C is a front view showing the state of the latch needle and neighboring parts;

FIG. 35D is an enlarged side view showing the posture of the latch needle;

FIG. 35E is a side view of FIG. 35A;

FIG. 36A is a plan view showing that the second thread is about to be caught in the hook for tying the second thread to the first thread (third phase);

FIG. 36B is an enlarged plan view showing the first loop and the second loop at the stem of the latch needle and the state of the second thread near the hook;

FIG. 36C is a front view showing the state of the latch needle and neighboring parts;

FIG. 36D is an enlarged side view showing the posture of the latch needle;

FIG. 36E is a side view of FIG. 36A;

FIG. 37A is a plan view showing that the second thread is caught in the hook to be pulled into the second loop for tying the second thread to the first thread (fourth phase);

FIG. 37B is an enlarged plan view showing the relationship between the first loop, the second loop and the second thread near the hook;

FIG. 37C is a front view showing the state of the latch needle and neighboring parts;

FIG. 37D is an enlarged side view showing the posture of the latch needle;

FIG. 37E is a side view of FIG. 37A;

FIG. 41A is a plan view showing the beginning end of the second thread released from the thread pressing unit and the hook, and the first loop diameter is reduced while the second loop becomes straight for tying the second thread to the first thread;

FIG. 41B is an enlarged plan view showing the relationship between the first loop, the second loop and the second thread near the hook;

FIG. 41C is a front view showing the state of the latch needle and neighboring parts;

FIG. 41D is an enlarged side view showing the posture of the latch needle;

FIG. 41E is a side view of FIG. 41A;

FIG. 42 is a plan view showing that a knot in the first thread and the second thread is made;

FIG. 43A is an enlarged plan view of the knot;

FIG. 43B shows the knot in loose state;

FIG. 43C shows that the beginning end of the second thread is inserted into the first loop and the second loop in a loose state before the knot is made.

FIG. 44 is a plan view showing that the second thread is moved to the thread supply position with the first thread and the second thread tied;

FIG. 45 is a time chart showing an operation status of each member (unit) for thread tying;

FIG. 46A is a plan view of a reducing unit to decrease the knot size in a first embodiment;

FIG. 46B is a sectional view taken along line 46B—46B of FIG. 46A; and FIG. 47 is a plan view of the reducing unit in a second embodiment.

DETAILED DESCRIPTION OF PREFERRED EMBODIMENTS

Figure 1:
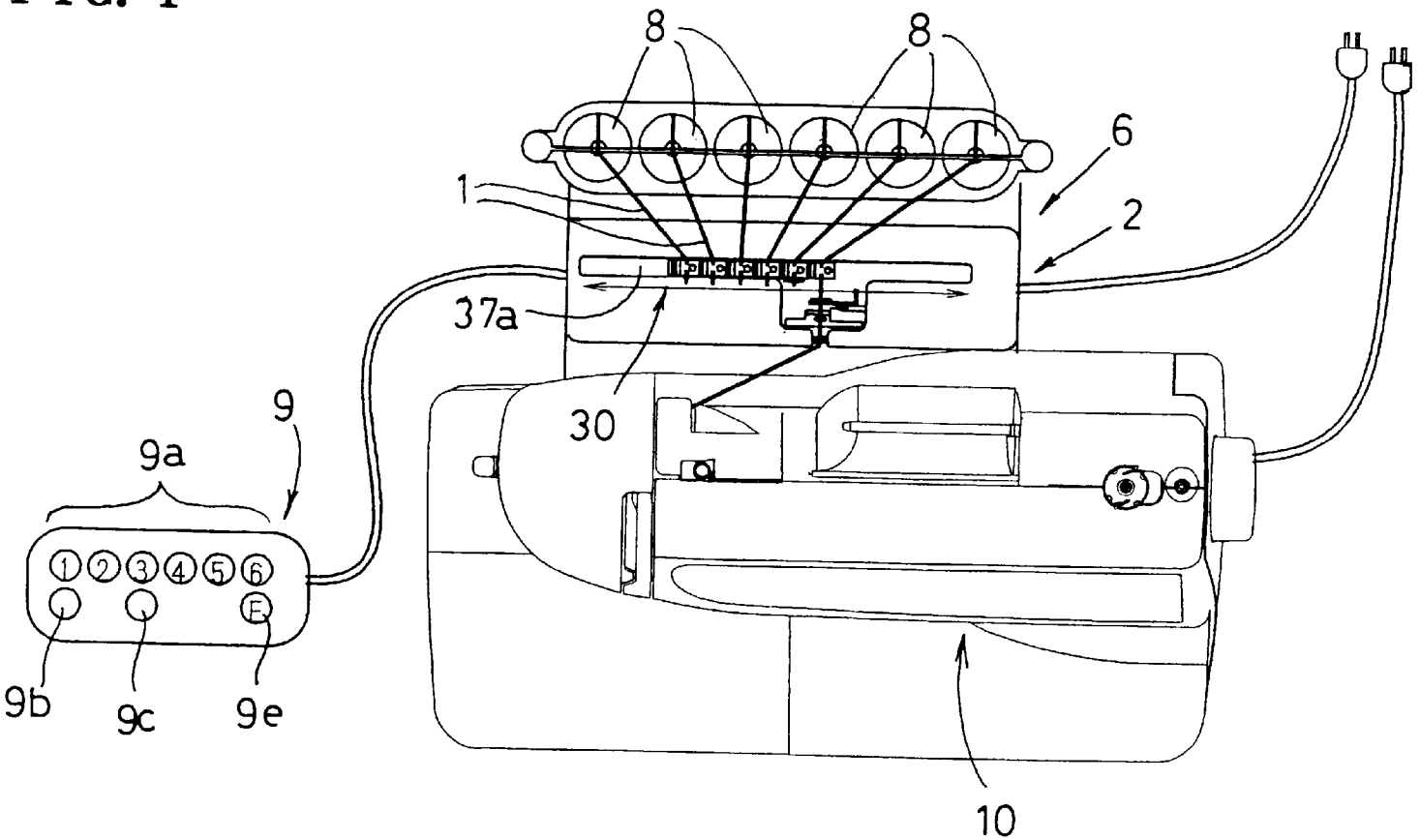
FIG. 1 is a plan view of an embroidery machine and a thread tying apparatus of the invention.
Figure 3:
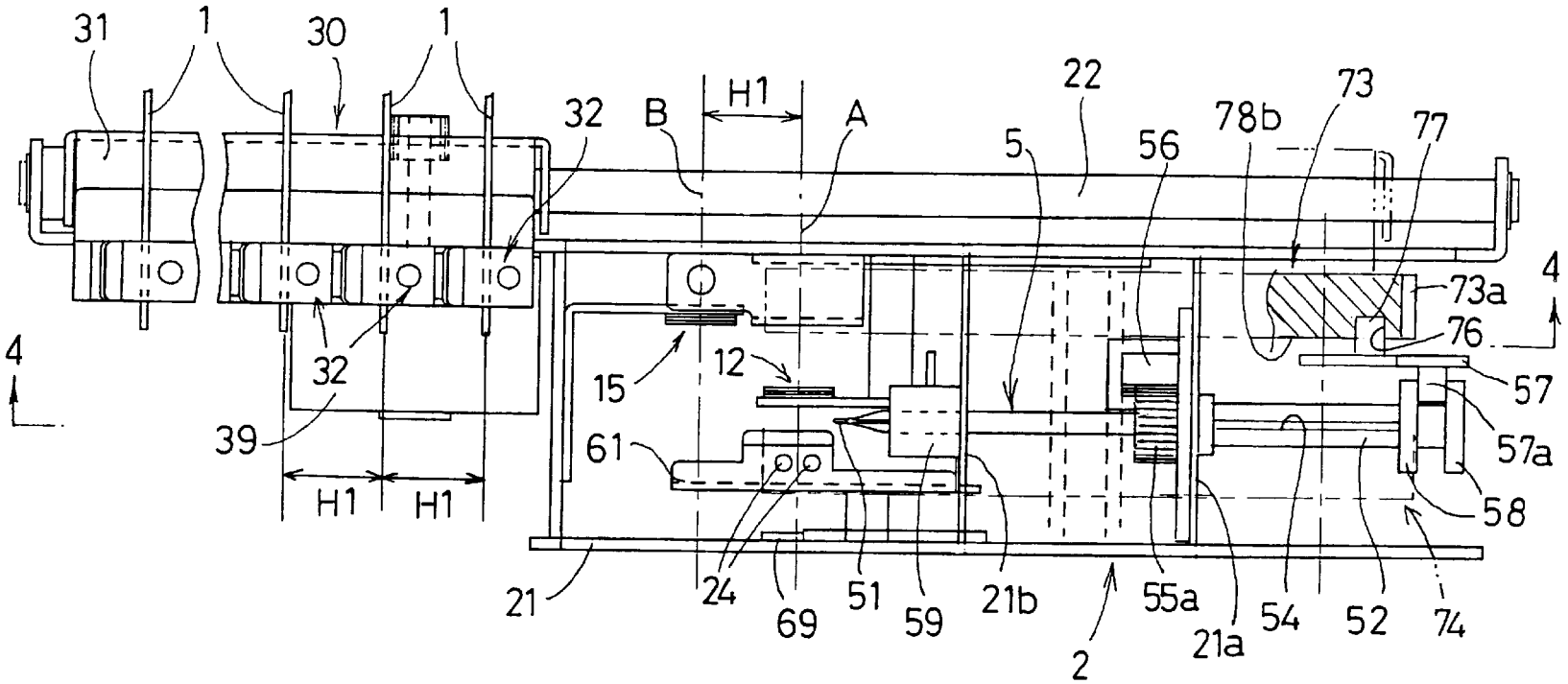
FIG. 3 is a rough plan view of the thread tying apparatus.
Figure 4:
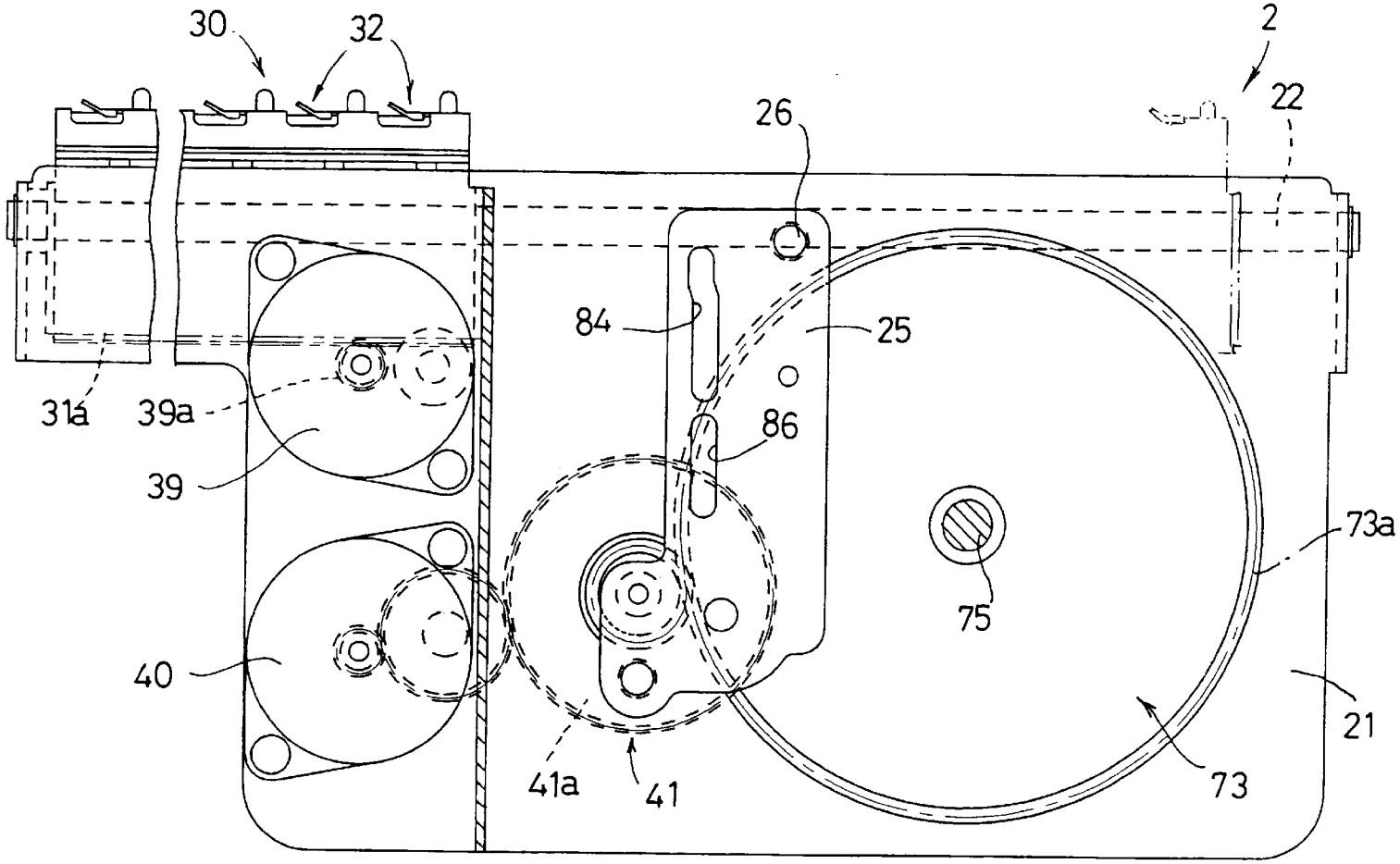
FIG. 4 is a sectional view taken along line 4—4 of FIG. 3.
Figure 5:
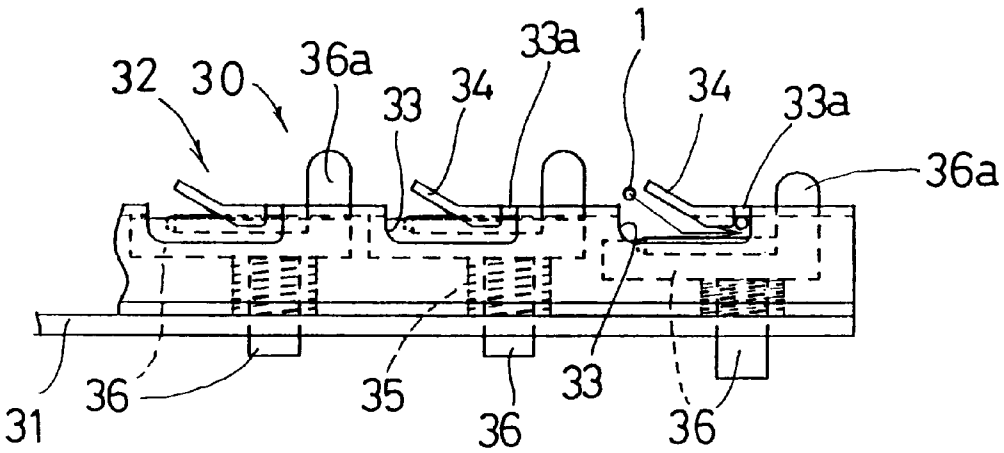
FIG. 5 is an enlarged front view showing essential parts of a thread supply unit.

One preferred embodiment of the invention will be described in detail with reference to the accompanying drawings. FIG. 1 is a plan view of an embroidery machine 10 where a thread tying apparatus 2 of the invention is applied, FIG. 2 is a side view of FIG. 1, FIG. 3 is a plan view showing main parts of the thread tying apparatus 2, and FIG. 4 is a sectional view taken along line 4—4 of FIG. 3.

A thread tying method according to the invention is performed as follows. With a first thread 1*a* being held at its tail end AX, a first loop 110 is made. The first thread 1*a* is passed through the first loop 110 and a second loop 111 is made thereinto. A beginning end BY of a second thread 1*b* is inserted into the second loop 111, the second loop 111 is pulled into the first loop 110, and the beginning end BY of the second thread 1*b* is tied in the first loop 110 of the first thread 1*a* (see FIGS. 43A–43C).

Figure 2:
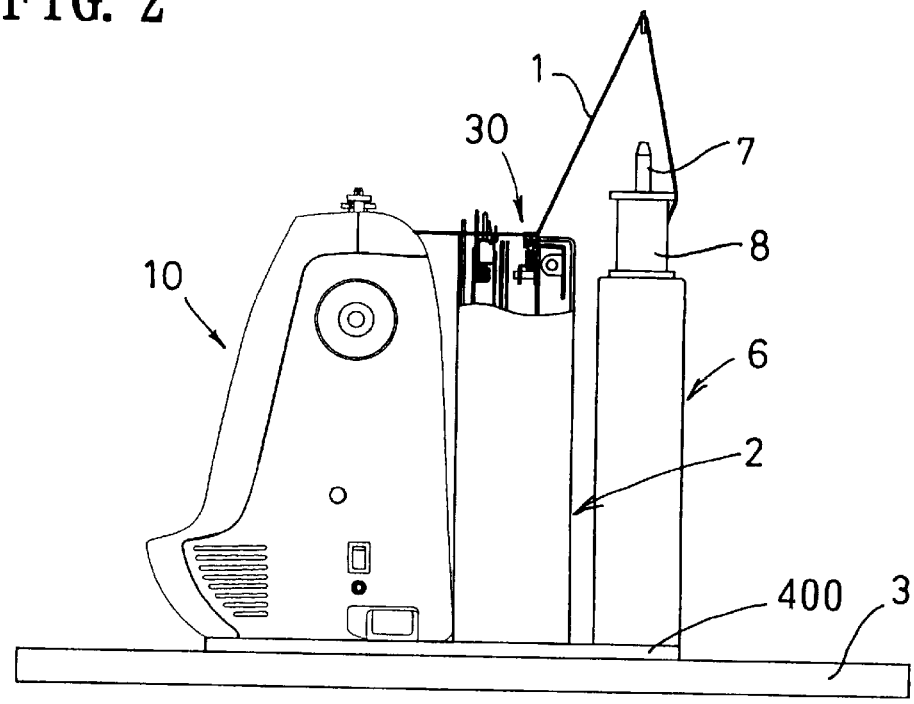
FIG. 2 is a side view of the embroidery machine and the thread tying apparatus.

As shown in FIGS. 1 and 2, the thread tying apparatus 2 that performs the thread tying method according to the invention stands on a base 400 mounted on a top plate 3 of a table. The embroidery machine 10 is placed at the front of the thread tying apparatus 2 on the base 400. Behind the thread tying apparatus 2, a spool stand 6 stands on the base 400. On the top of the spool stand 6, a plurality of spool pins 7 are disposed horizontally in a row and spools 8, each having thread, are detachably placed on corresponding spool pins 7. A switch box 9 for selecting a thread among the spools 8 for thread tying is provided to an end of a cord extending from the thread tying apparatus 2.

Next, a structure of the thread tying apparatus 2 will be described. As shown in FIGS. 3 and 4, a guide rail 22 having a round shaft is longitudinally disposed behind at an upper portion of a frame 21 of the thread tying apparatus 2. A unit frame 31 of a thread selection unit 30 is fitted around the guide rail 22 so that the unit frame 31 is movable from side to side. A rack gear 31*a* is formed at a bottom edge of the unit frame 31. A pinion 39*a* of a first driving motor 39, which is fixed at one end of the frame 21, is engaged in the rack gear 31*a*. The first driving motor 39, which is, for example, a stepping motor that can rotate in both normal and reverse directions, is driven in a predetermined direction, thereby moving the thread selection unit 30 to a specified position from side to side along the guide rail 22.

Figure 6A:
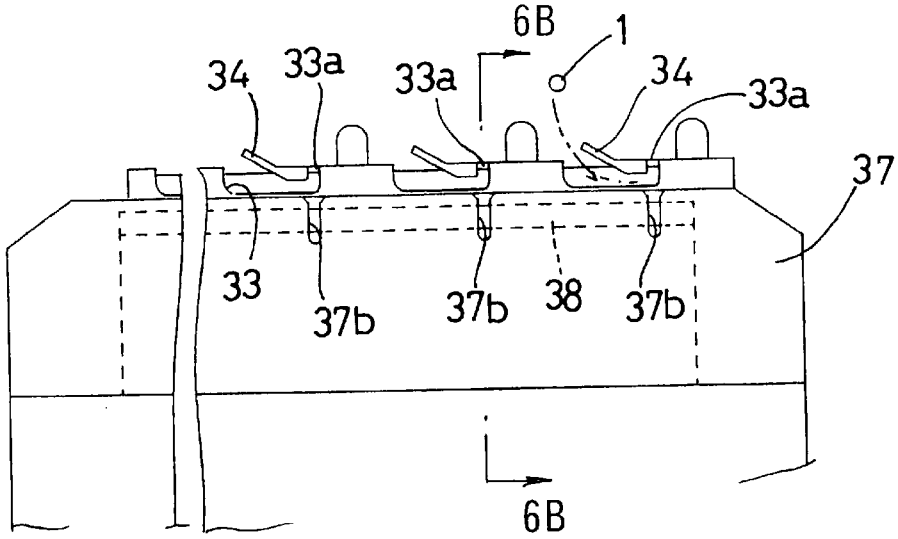
FIG. 6A is an enlarged front view of a thread cutter when the thread supply unit is placed in position.
Figure 6B:
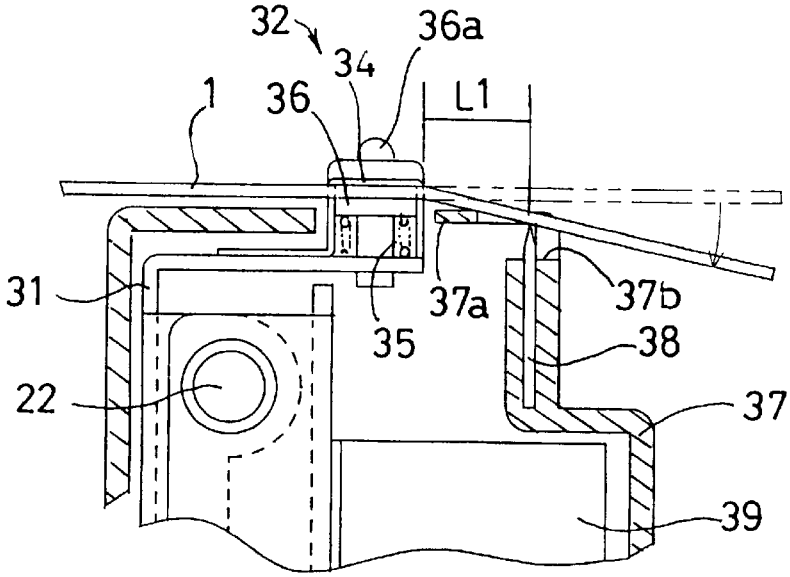
FIG. 6B is a sectional view taken along line 6B—6B of FIG. 6A.

As shown in FIGS. 3, 4, 5, 6A and 6B, the thread selection unit 30 includes a plurality of thread holding parts 32 disposed on the unit frame 31 at regular intervals of H1 along an axis of the guide rail 22. Each thread holding part 32 includes a tab 34 provided with a guiding groove 33 for guiding a thread, which is inserted downward from the top. A pressing member 36, urged toward the tab 34 from the bottom by use of a spring 35 to hold the thread 1, is disposed so that it can move vertically. By pressing a pin 36*a*, that projects upward from the pressing member 36 downward against a force of the spring 35, the thread 1 is inserted and maintained in the guiding groove 33. A furthest rear portion of the guiding groove 33 is a thread position 33*a* where a thread is disposed in position (see FIG. 5). At a place where it is easy to cut a thread manually in the thread tying apparatus 2, for example, to a left side of the frame 21, as shown in FIGS. 6A and 6B, a thread cutting part is provided. In the thread cutting part, on a top surface of a cutter cover 37, a guiding groove 37*a* where the thread holding part 32 of the thread selection unit 30 passes through is formed in parallel to the axis of the guide rail 22. In addition, cutter grooves 37*b* are formed in a downward direction at regular intervals (H1) of the thread positions 33*a*. A cutter knife 38 is fixed facing upward to an inner surface of the cutter cover 37 (see FIGS. 6A and 6B). By doing so, an end of the thread 1 extending from the thread position 33*a* in each thread holding part 32 is inserted into the corresponding cutter groove 37*b*. As shown in FIG. 6A, when the user pulls the end of the thread 1 downward while holding down the thread 1 at the top surface of the cutter cover 37, the end of the thread 1 is cut while leaving a determined dimension L1 from the thread position 33*a*. Thus, the thread 1 is cut in advance for tying to the second thread 1*b* described later.

The frame 21 of the thread tying apparatus 2 includes a latch needle 5, a needle driving unit 11 (FIG. 8A) that moves the latch needle 5 back and forth and rotates the latch needle 5 in both the normal direction and the reverse direction, a first thread holding member 12 that holds the tail end AX of the first thread 1*a* described later, a first loop control unit 13 (FIG. 10A) that slidably makes contact with a stem 52 of the latch needle 5 and moves in the axial direction, a second thread holding member 15 that holds the beginning end BY of the second thread 1*b* described later and changes a position of the beginning end BY of the second thread 1*b* so as to be close to a hook 51 of the latch needle 5, a thread volume control unit 14 (FIG. 11C), and an interlock mechanism 18 (FIG. 10A) that interlocks the needle driving unit 11, the first loop control unit 13, the first thread holding member 12, the second thread holding member 15, the thread volume control unit 14 and a second thread pressing unit 19 (FIG. 10A) respectively on cue.

Figure 8A:
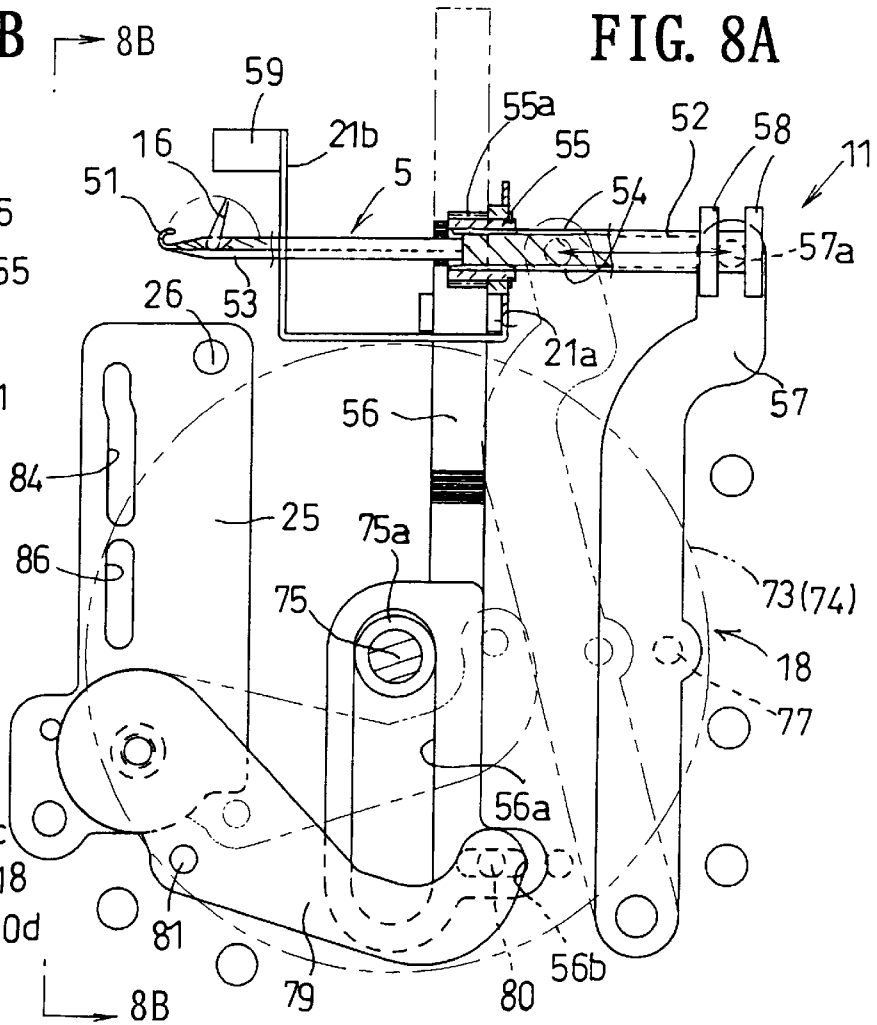
FIG. 8A is a front view showing a latch needle and an interlock mechanism thereof.
Figure 8B:
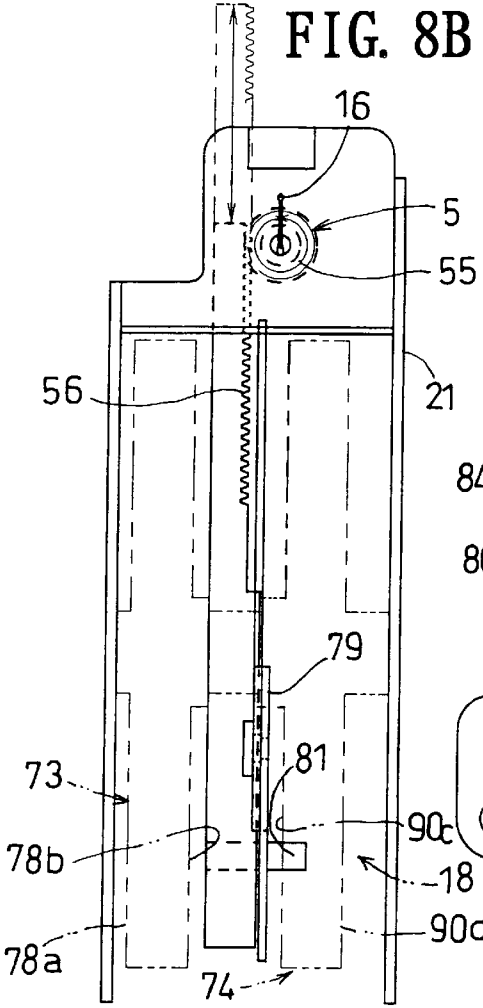
FIG. 8B is a sectional view taken along line 8B—8B of FIG. 8A.
Figure 9:
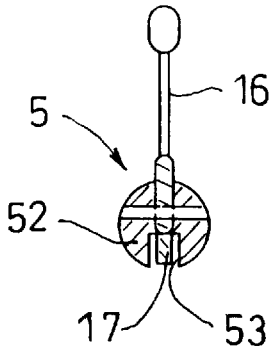
FIG. 9 is an enlarged sectional view of the latch needle.

As shown in FIGS. 8 and 9, the hook 51 is formed at a tip of the latch needle 5 and is made of steel (or any material is possible as long as it is attracted by a magnet). A latch 16, made of steel (or any material is possible as long as it is attracted by a magnet), is rotatably pivoted on the stem 52 about a pin. When a free end of the latch 16 makes contact with the end of the hook 51, the hook 51 is closed (close position). When the end of the latch 16 is away from the hook 51, it is close to a periphery of the stem 52 and the hook 51 is open (open position). At a forward part (which is closer to the hook 51) of the stem 52, a straight guiding groove 53 is formed along an axis of the stem 52 offset 180-degree from a side where the latch 16 is mounted. The first loop control unit 13 (FIG. 10A), shaped from a plate, includes a loop control part 17 projecting horizontally at a top end thereof. The first loop control unit 13 is structured to move horizontally and vertically so that the loop control part 17 is engaged in the guiding groove 53 (FIG. 9), and away from the latch needle 5 below the hook 51 (see FIGS. 9 and 10A).

The needle driving unit 11 is structured as follows. On the stem 52 of the latch needle 5, spline grooves 54 are formed following the guiding groove 53. The spline grooves 54 are engaged in a bearing 55, which is rotatably mounted to a division wall member 21*a* of the frame 21, so that the spline grooves 54 are movable only axially. The stem 52 of the latch needle 5 is slidably supported in an opening provided in another division wall member 21*b* (see FIG. 8A). A rack 56 moves vertically and is engaged with a gear 55*a* formed around the bearing 55. The rack 56 is moved vertically at a predetermined time by the interlock mechanism 18 described later, rotating the latch needle 5 in normal direction or reverse direction (see FIGS. 8A and 8B). In addition, as shown in FIG. 8A, a pin 57*a* of a needle driving lever 57 is disposed between a pair of disks 58, 58 provided at the rear end of the stem 52 of the latch needle 5. The needle driving lever 57 is structured so as to move the latch needle 5 back and forth in the axial direction of the axis when the interlock mechanism 18 operates.

As shown in FIGS. 3 and 8A, a magnet 59 is attached to an upper part of the division wall member 21*b*. When the latch needle 5 is moved backward with the hook 51 facing upward, the free end of the latch 16 is positioned away from the hook 51 so as to be close to the stem 52 because of a magnetic force of the magnet 59, and the hook 51 is opened.

Next, the first thread holding member 12 and the second thread holding member 15, that hold the tail end AX of the first thread 1*a* and the beginning end BY of the second thread 1*b*, respectively, will be described. In the frame 21, shown in FIGS. 3 and 11A, a position A is a thread supply position. At the thread supply position A, a thread from a spool 8 to perform embroidering is supplied to the embroidery machine 10, and the thread is called the first thread 1*a*. A thread that is tied to the tail end AX of the first thread 1*a* is called the second thread 1*b*.

Figures 11A, 11B, 11C, 11D:
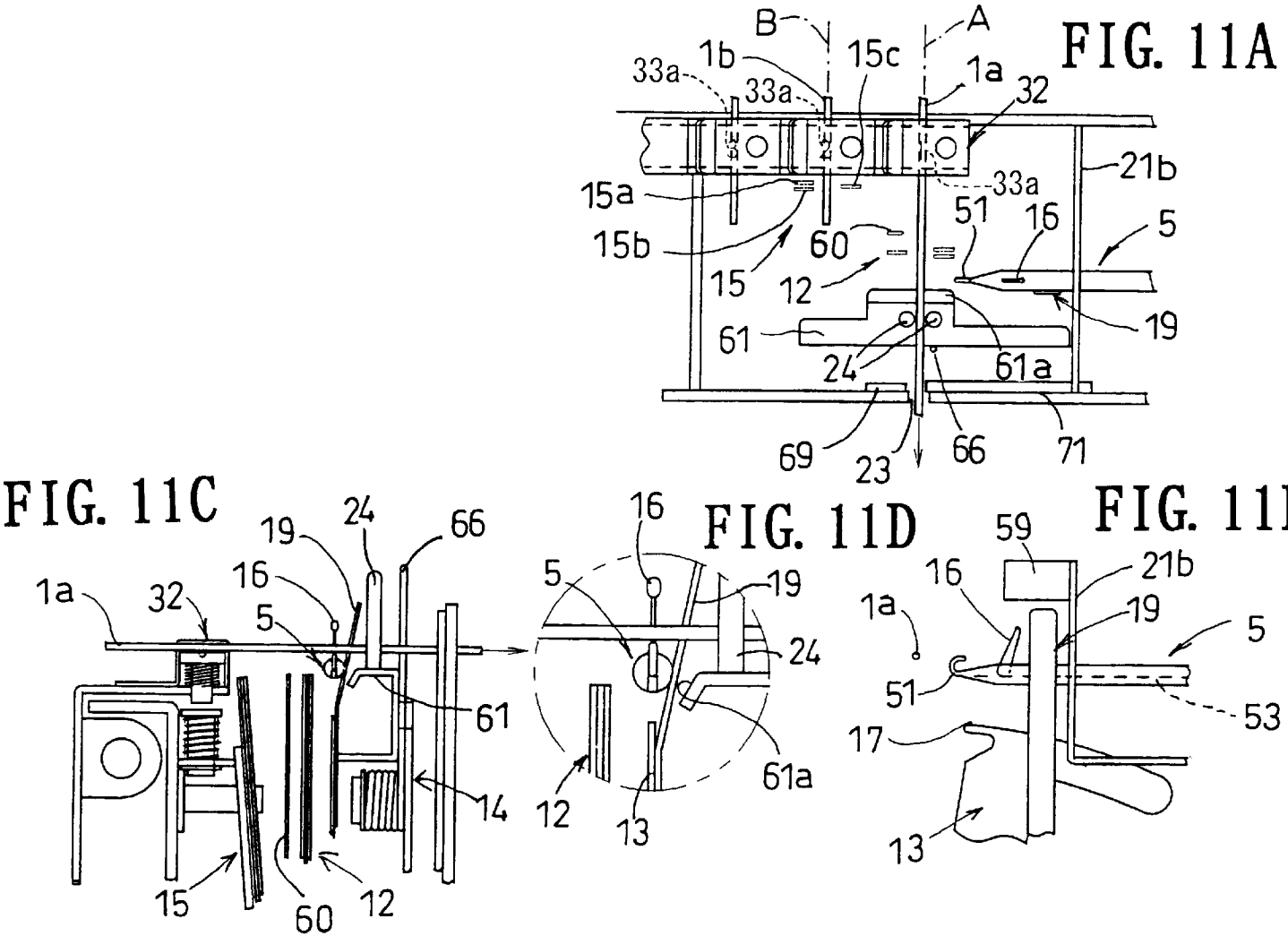
FIG. 11A is a plan view showing that a thread is supplied.
FIG. 11B is a front view showing the state of the latch needle.
FIG. 11C is a side view of FIG. 11A.
FIG. 11D is an enlarged side view showing essential parts of FIG. 11C.
Figure 12A:
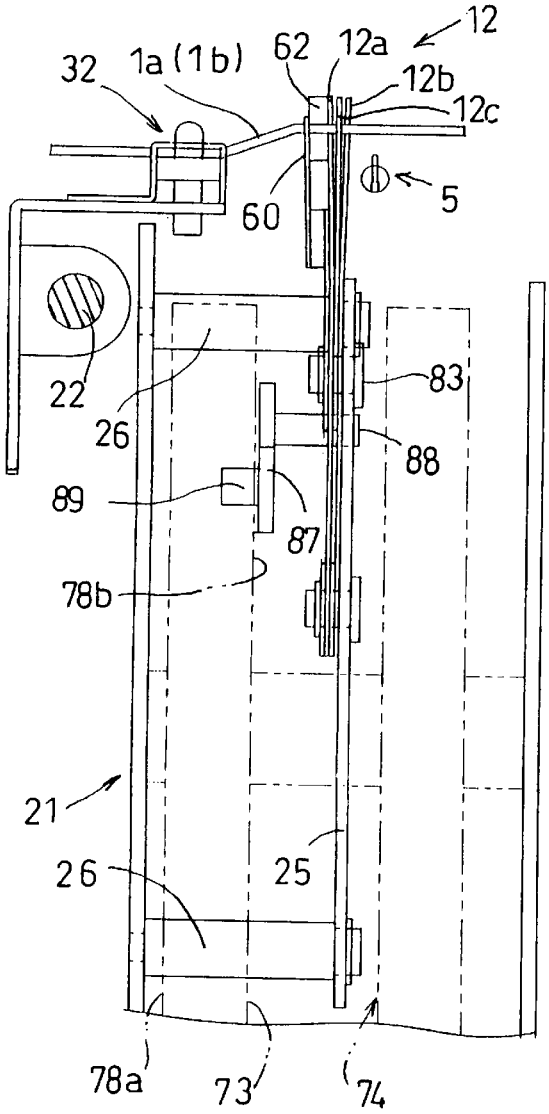
FIG. 12A is a left side view showing a first thread holding member and an interlock mechanism thereof.
Figure 12B:
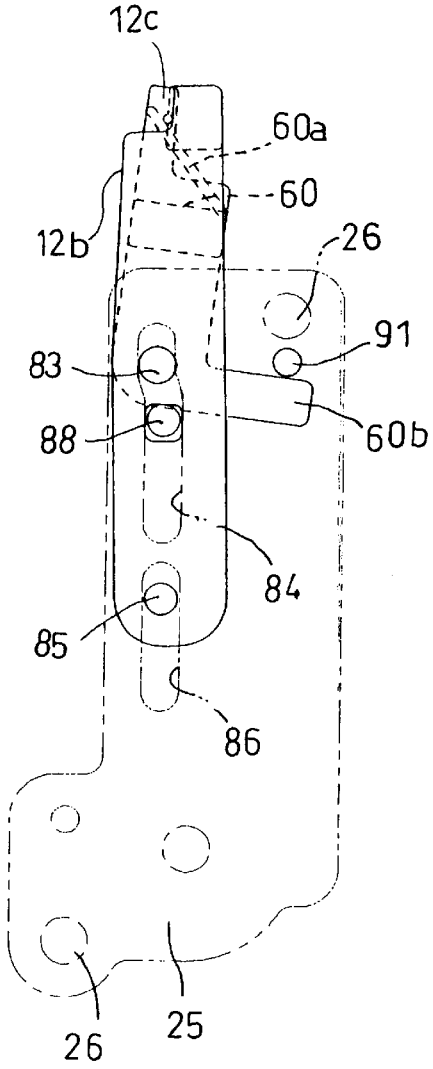
FIG. 12B is a front view of FIG. 12A.
Figure 22A:
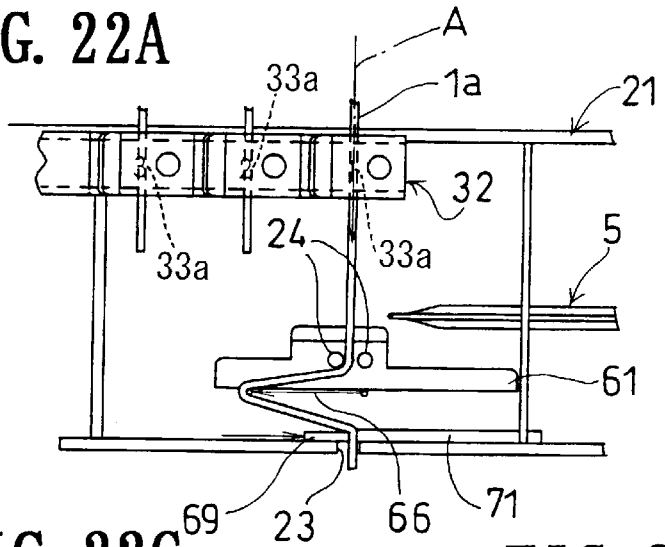
FIG. 22A is a plan view showing that after a thread exit of the first thread is closed, the latch is in an upright position for forming a first loop.

One of threads 1 maintained at the thread holding parts 32 of the thread selection unit 30 (in this embodiment, the thread held by the right most thread holding part 32, FIG. 22A) is regarded as the first thread 1*a*. When the first thread 1*a* is set in the thread supply position A, a thread exit 23 and the thread position 33*a* become aligned with each other and the thread 1*a* passes between a pair of thread guides 24, which are round shafts when viewed from the top as shown in FIG. 11A.

Figure 24A:
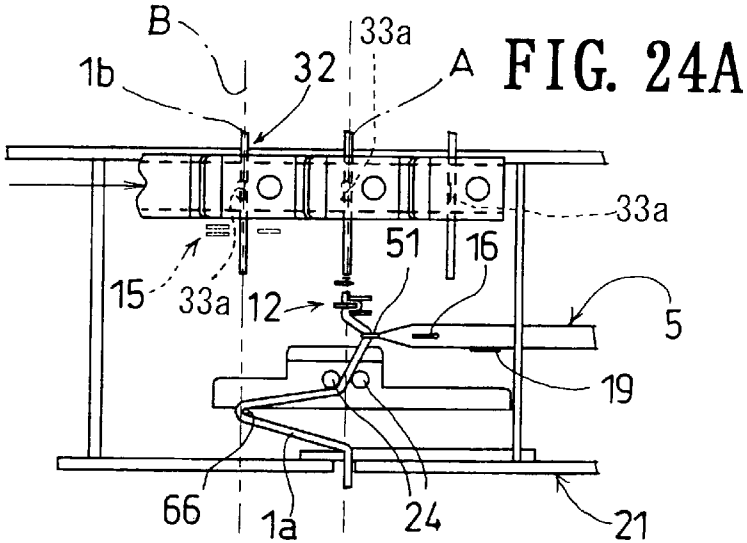
FIG. 24A is a plan view showing that the first thread is caught in the hook for forming the first loop.

Upon a start of thread tying operation, the second thread 1*b* is selected from threads 1 held by the respective thread holding parts 32 (in this embodiment, the thread held by the third thread holding part 32 from the right in the thread selection unit 30 as shown in FIG. 24A). After the first thread 1*a* is cut by a first thread cutter 60 at the thread supply position A, the thread selection unit 30 is moved so that the thread position 33*a* for the second thread 1*b* comes to a thread tying position B in the frame 21. The thread tying position B is situated away from the thread supply position A in a direction where the latch needle 5 moves forward. In this embodiment, as shown in FIG. 3, a distance between the thread tying position B and the thread supply position A is equal to the interval H1 between the thread positions 33*a*. However, the distance between the thread tying position B and the thread supply position A can be set freely.

With reference to FIGS. 10, 11, 12, 13, and 16A, structures of the first thread holding member 12 and the first thread cutter 60 will be described. Between the thread holding part 32 situated in the thread supply position A and a stand 61 where the thread guide 24 stands (FIG. 12A), a pair of outside plates 12*a*, 12*b* of the first thread holding member 12 are disposed on one side of the first thread 1*a* that passes through the thread supply position A, and an inner plate 12*c* is disposed on another side. When the inner plate 12*c* is inserted into a gap between the outside plates 12*a*, 12*b*, the first thread 1*a* is bent and pressed among the outside plates 12*a*, 12*b* and the inner plate 12*c*, so as not to come off therefrom. The outside plates 12*a*, 12*b* are warped inward at their ends (toward the end of the inner plate 12*c*), ensuring that the first thread 1*a* is bent and pressed between the outside plates 12*a*, 12*b* and the inner plate 12*c*.

Figure 13B:
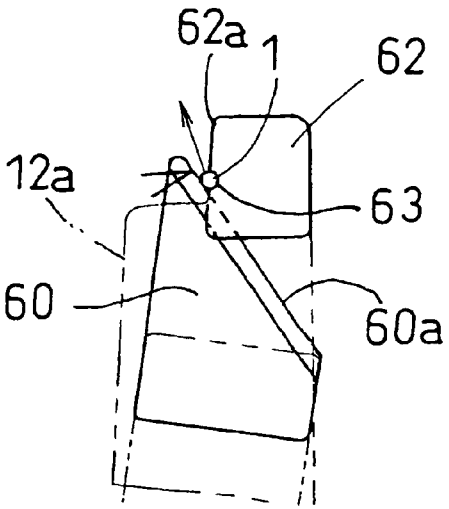
FIG. 13B is an enlarged front view showing a first thread cutter and neighboring parts.
Figure 13A:
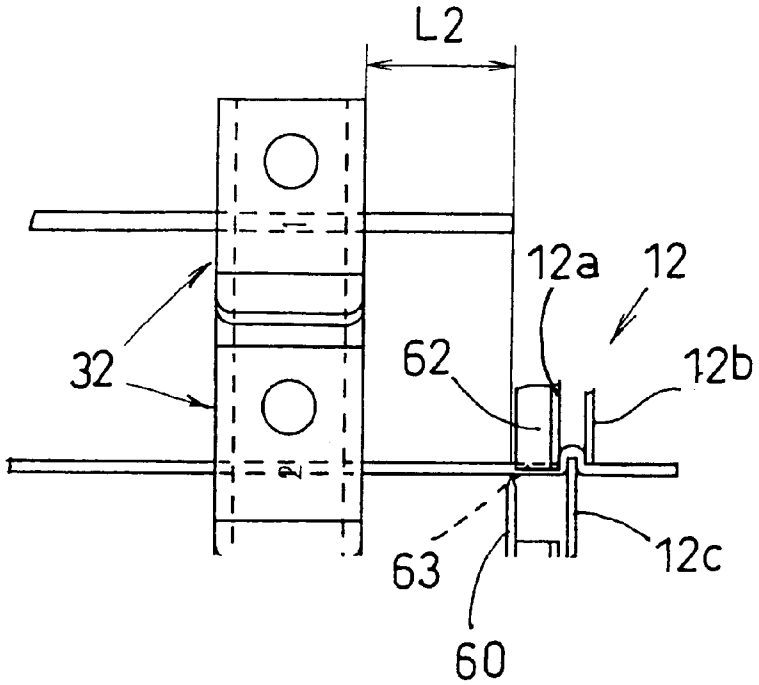
FIG. 13A is an enlarged plan view showing essential portion of the first thread holding member.
Figure 14:
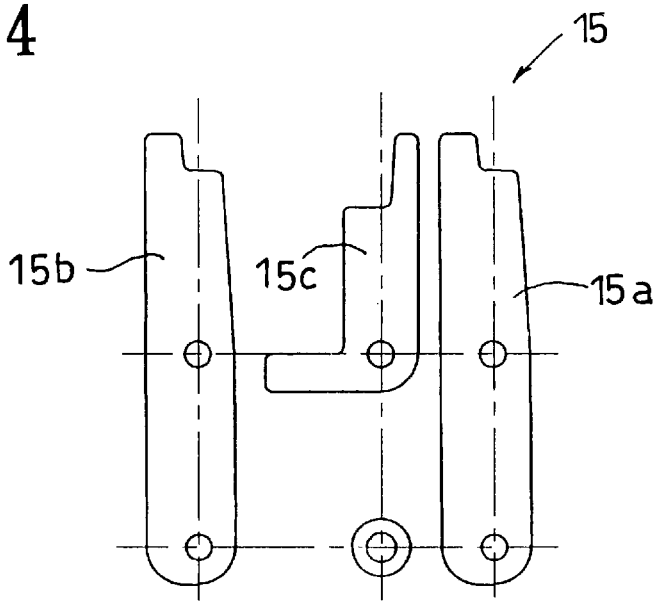
FIG. 14 is a front view of a second thread holding member.
Figure 15A:
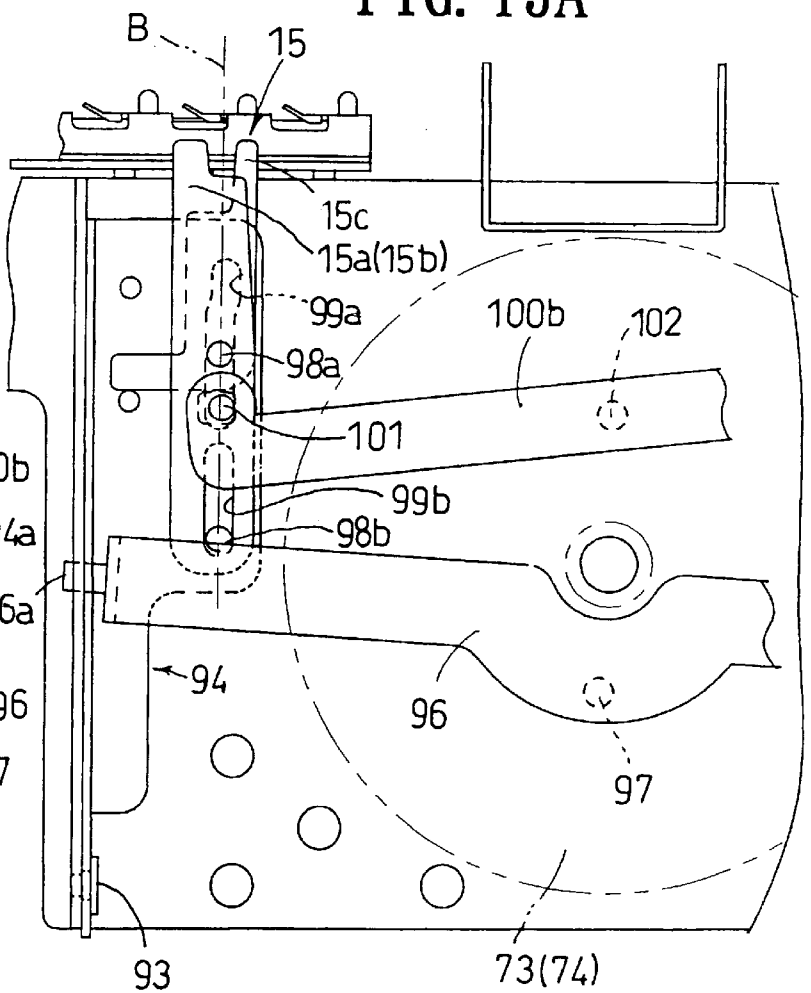
FIG. 15A is a front view showing the second thread holding member, a second thread movable member, and interlock mechanism thereof.
Figure 15B:
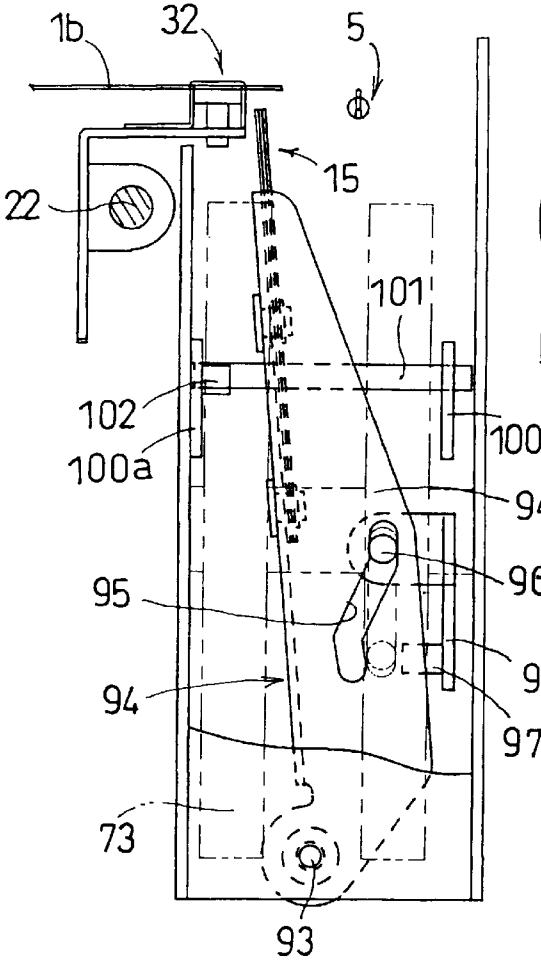
FIG. 15B is a left side view of FIG. 15A.

A cutter base 62 designed to cut the thread between an edge 60*a* of the first thread cutter 60 and the cutter base 62 is integrally provided with the outside plate 12*a*, which is closest to the thread holding part 32 as shown in FIG. 13A. As shown in FIG. 13B, a substantially arc-shaped groove 63 for controlling movement of the thread, where the thread is fitted, is formed on a surface 62*a* of the cutter base 62 extending toward the length of the thread. When the edge 60*a* of the first thread cutter 60 approaches the surface 62*a* of the cutter base 62 on a slant, the thread is controlled at the groove 63 so as not to escape from the edge 60*a*, thereby ensuring cutting.

The second thread holding member 15 is made of a pair of outside plates 15*a*, 15*b*, and an inner plate 15*c*, which are used to hold the beginning end BY of the second thread 1*b*, as is the case with the first thread holding member 12, as shown in FIGS. 11A, 14 to 17, and is linked to the interlock mechanism 18 described later.

Figure 18A:
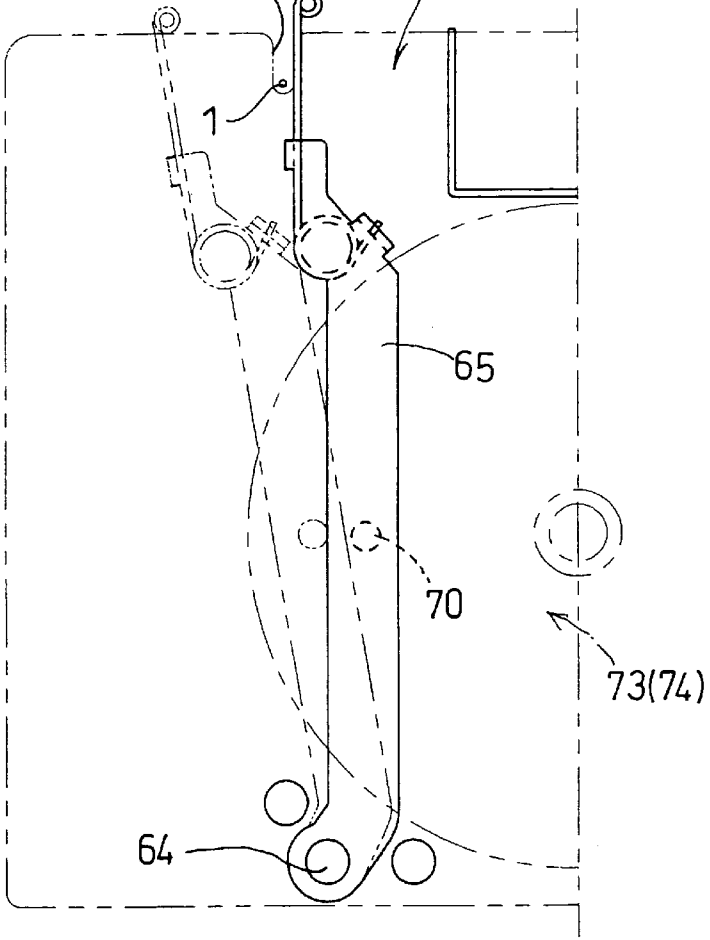
FIG. 18A is a front view showing the thread volume control unit and an interlock mechanism thereof.
Figure 18B:
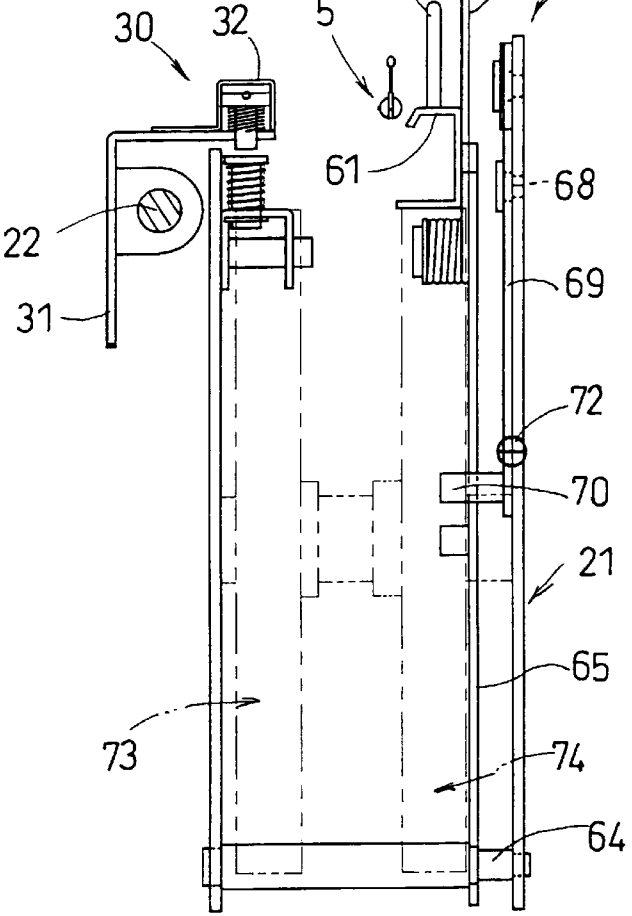
FIG. 18B is a left side view of FIG. 18A.

FIGS. 18A and 18B show the thread volume control unit 14. A spring shaft 66, having an improved elasticity because of a coiled end, stands on an end of a long lever 65. The long lever of 65 is rotatably mounted to a lower part of the frame 21, using a pin 64, and extends upward. The thread volume control unit 14 is disposed opposite to the latch 5 across the stand 61 where the thread guides 24 stand, as shown in FIG. 18B.

Figure 19:
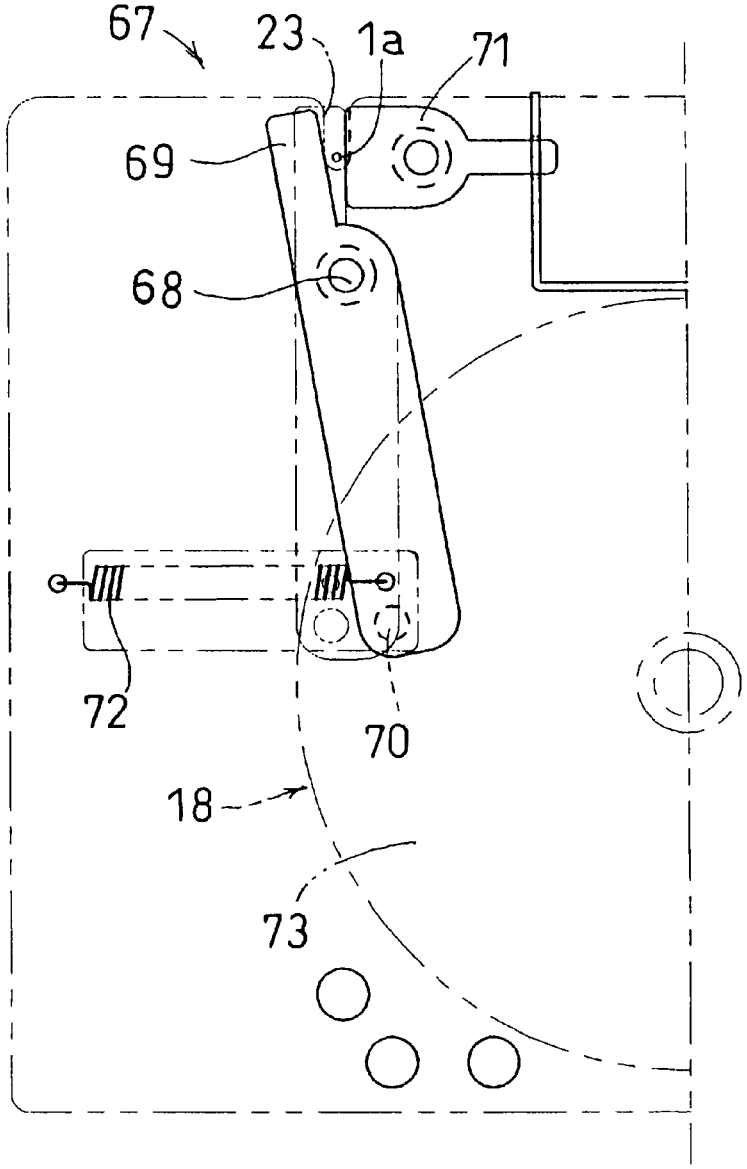
FIG. 19 is a front view showing the second thread pressing unit and an interlock mechanism thereof.

FIGS. 18B and 19 show a first thread exit holding unit 67 that tightly holds the first thread 1*a* passing through the thread supply position A at the thread exit 23 of the frame 21 so as to maintain the thread straight. A holding lever plate 69, which is biased by a spring 72, is rotatably mounted to an inner surface of the frame 21 via a pin 68. In touch with the thread exit 23, an upper side surface of the holding lever plate 69 makes contact with or is away from an end surface of a backing plate 71 that is mounted inside the frame 21 using a pin and rotatable over a very small angle. The first thread exit holding unit 67 holds the first thread 1*a*, passing through the thread exit 23, between the holding lever plate 69 and the backing plate 71. A cam pin 70, projecting at the bottom of the holding lever plate 69, is engaged with a second cam 74 in the interlock mechanism 18. The holding lever plate 69 and the backing plate 71 are linked with each other so that the upper part of the holding lever plate 69 is separated from the backing plate 71 at a predetermined time against a spring force of the spring 72.

The next description is about a structure of the interlock mechanism 18 that interlocks the needle driving unit 11, the first loop control unit 13, the first thread holding member 12, the second thread holding member 15, the thread volume control unit 14 and other parts, respectively, on cue.

Figure 7:
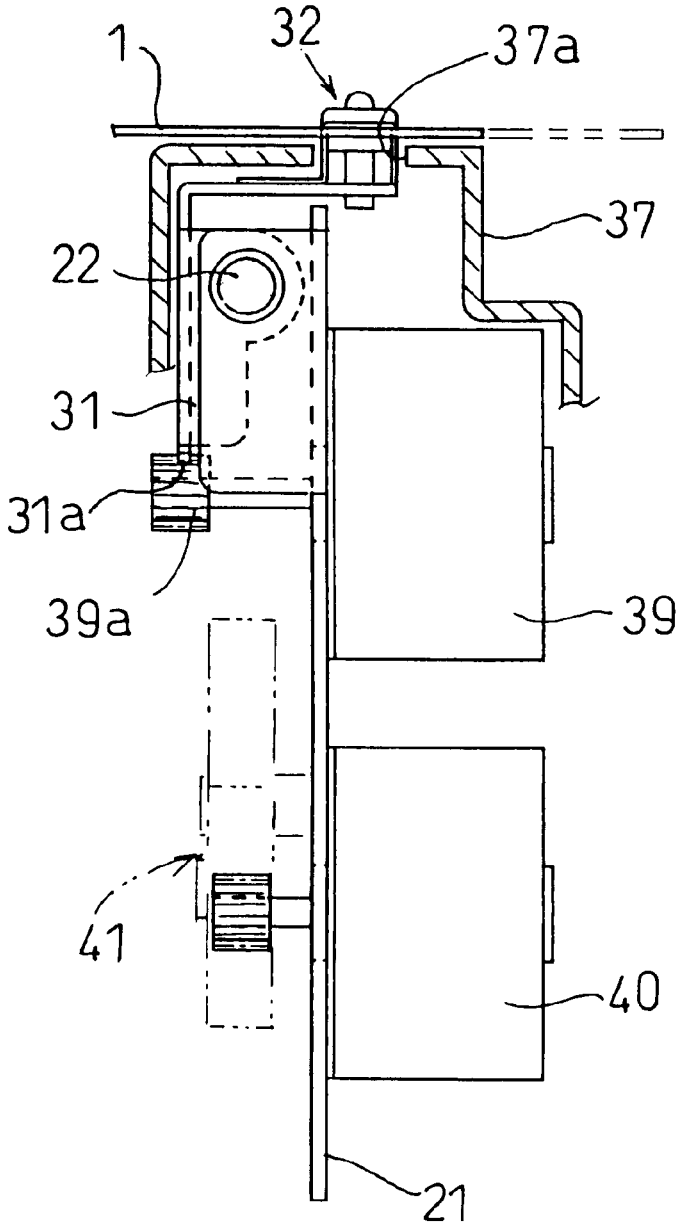
FIG. 7 is a side view showing driving motors.

As shown in FIGS. 3 and 4, the interlock mechanism 18 is disposed within the frame 21. A first cam 73 and the second cam 74 are fitted around a supporting shaft 75 so as to integrally rotate on the supporting shaft 75. The first cam 73 is disposed near the guide rail 22, and the second cam 74 is disposed at the front of the latch needle 5. As shown in FIGS. 4 and 7, a second driving motor 40 is mounted in the frame 21 and rotates in a fixed direction to allow the first cam 73 to be rotated via a gear driving mechanism 41 which engages with a gear portion 73*a* formed around the first cam 73. When the first cam 73 and the second cam 74 go into a 360-degree rotation from a predetermined initial phase position, the cycle of tying the first thread 1*a* and the second thread 1*b* is completed. An operation starting phase (reference position) and an ending phase can be detected at a limit switch by a detecting part provided in a periphery of the second cam 74. An intermediate frame 25 (FIGS. 12A and 12B), which is disposed inside the frame 21, is supported at pins 26 and is structured to support an intermediate gear 41*a*.

A cam pin 77 (FIG. 8A), projecting at substantially a midpoint of the needle operating lever 57, is engaged into a circular cam groove 76 (FIG. 3) which is formed on a B cam surface 78*b* (on a side facing the second cam 74) of the first cam 73. When the first cam 73 is rotated in a predetermined direction, the latch needle 5 is moved back and forth in an operating range of the needle operating lever 57 as shown in FIG. 8A (in a range from the latch needle 5 represented in solid line to that in double dashed chain line). In FIG. 8A, when the needle operating lever 57 is represented in the solid line, the latch needle 5 is moved back furthermost.

As shown in FIG. 8A, a longitudinal guide slot 56*a*, formed at the bottom of the rack 56 is slidably engaged with a boss 75*a* fitted around the supporting shaft 75 in the second cam 74. A rack operating pin 80, projecting at an end of a needle rotating lever 79, which is pivotally mounted to the intermediate frame 25 at its bottom, is fitted into a horizontal guide slot 56*b* formed at the bottom of the rack 56. A cam pin 81, projecting substantially midway of the needle rotating lever 79, is engaged into a circular cam groove (not shown) formed on a C cam surface 90*c* (facing the B cam surface 78*b* on the first cam 73) of the second cam 74. When the second cam 74 is rotated in a predetermined direction, the needle rotating lever 79 is moved vertically, the rack 56 is moved vertically, and the latch needle 5, as described later, is rotatably moved only for a predetermined phase (angle) in a predetermined direction in a predetermined section, retaining the phase position.

The first thread holding part 12 and the interlock mechanism 18 of the first thread cutter 60 will be described with reference to FIGS. 12A, 12B, 13A, and 17A. The bottom of the first thread cutter 60 and the three plates 12*a*–12*c* of the first thread holding member 12 (the outside plates 12*a*, 12*b*, and the inner plate 12*c*) are supported in a bundle at an upper supporting shaft 83. The upper supporting shaft 83 is movable vertically along a longitudinal upper guide slot 84 of the intermediate frame 25 fixed in the frame 21. Bottoms of the outside plates 12*a*, 12*b* are linked to a lower supporting shaft 85, and movable vertically along a longitudinal lower guide slot 86 of the intermediate frame 25. An operating shaft 88, linking the outside plates 12*a*, 12*b* and an end of a first thread holding lever 87, is fitted into the upper guide slot 84. On the right side of the frame 21, a cam pin 89 of the first thread holding lever 87, which is mounted via a horizontal shaft (not shown), is fitted into the circular cam groove (not shown) formed on the B cam surface 78*b* of the first cam 73. As the upper supporting shaft 83 is moved upward, the first thread 1*a* is bent and caught between the outside plates 12*a*, 12*b* and the inner plate 12*c* as shown in FIG. 13A. During roughly the same period, when an arm 60*b* at the bottom of the first thread cutter 60 is restricted at an undersurface of a control pin 91 projecting in the intermediate frame 25 (FIG. 12B), the upper supporting shaft 83 is moved upward, and the edge 60*a* of the first thread cutter 60 approaches the cutter base 62 on a slant, cutting the first thread 1*a*. As shown in FIG. 13B, when the edge 60*a* of the first thread cutter 60 approaches the surface 62*a* of the cutter base 62 on the slant, the groove 63 prevents the thread from escaping from the edge 60*a*, thereby ensuring the cutting.

The structure and movement regarding the relationship between the second thread holding member 15 and the interlock mechanism 18 will be described with reference to FIGS. 14 to 17B. A second thread movable member 94 in an L-shape in cross section is rotatably mounted to a partition plate 27 in the frame 21 at the bottom by means of a shaft 93, whose axis is parallel to the direction the latch needle 5 is moved back and forth.

Figure 16A:
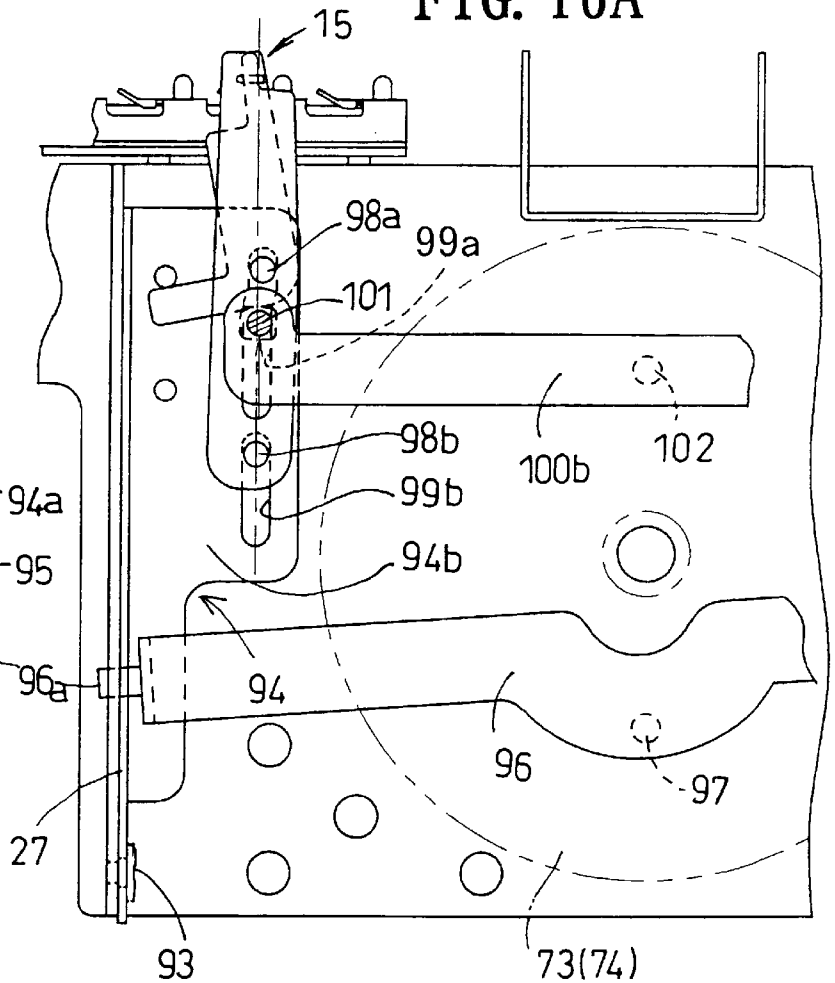
FIG. 16A is a front view showing the second thread holding member and an interlock mechanism thereof when the second thread holding member moves forward.
Figure 16B:
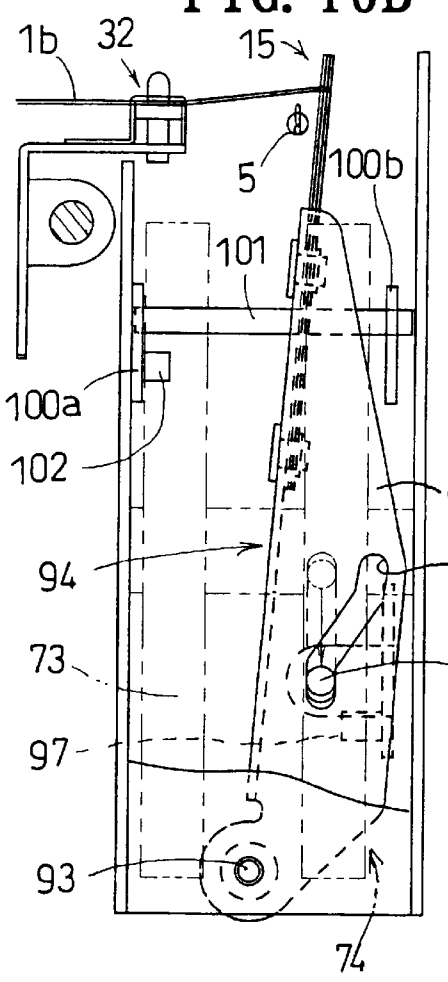
FIG. 16B is a left side view of FIG. 16A.
Figures 17A, 17B:
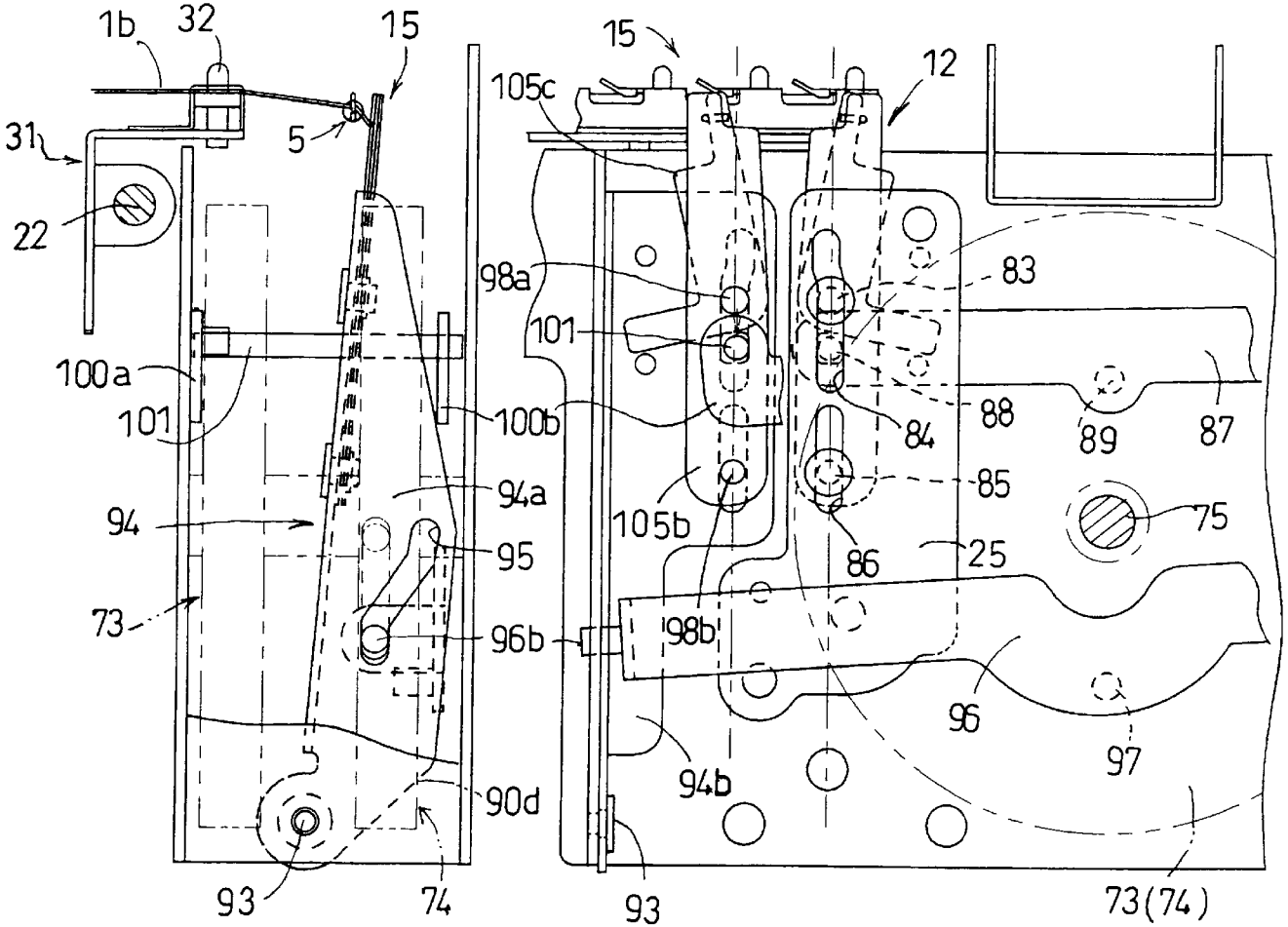
FIG. 17A is a front view when the second thread is caught in the hook.
FIG. 17B is a left side view of FIG. 17A.

There is a guide slot 95 in a plate 94*a* of the second thread movable member 94 on the side where the shaft 93 is mounted as shown in FIG. 16B. A movable lever 96 having an operating pin 96*a* fitted in the guide slot 95 is mounted to the right side of the frame 21 so as to be pivoted on a shaft, not shown. A cam pin 97 projects substantially from a midpoint of the movable lever 96 and is energized in a circular cam groove (not shown) formed on a D cam surface 90*d* of the second cam 74. Thus, the second thread movable member 94 can be moved selectively toward the back of the frame 21 so that an upper end (where the second thread 1*b* is held) of the second thread holding member 15 comes close to the thread holding part 32 of the thread selection unit 30 (FIG. 15B), and toward the front of the frame 21 so that the upper end (where the second thread 1*b* is held) of the second thread holding member 15 leans to the thread exit 23 over the latch needle 5.

Similarly to the case with the first thread holding member 12, the outside plates 15*a*, 15*b* and the inner plate 15*c* of the second thread holding member 15 are supported in a bundle at an upper supporting shaft 98*a*. The upper supporting shaft 98*a* is vertically movable along an upper guide slot 99*a* formed in a face plate 94*b* of the second thread movable member 94, which is parallel to the axis of the latch needle 5. As the bottoms of the outside plates 15*a*, 15*b* are linked to a lower supporting shaft 98*b*, the outside plates 15*a*, 15*b* are vertically movable along a lower guide slot 99*b* formed on the face plate 94*b*. The pair of outside plates 15*a*, 15*b* and a pair of second thread holding levers 100*a*, 100*b* are linked to an operating shaft 101 at ends thereof. The operating shaft 101 is fitted in the upper guide slot 99*a*. Of the second thread holding levers 100*a*, 100*b* mounted to the right side of the frame 21 via a horizontal shaft (not shown), a cam pin 102 of the second thread holding lever 100*a* disposed on the back of the first cam 73, is fitted in a circular cam groove (not shown) formed on an A cam surface 78*a* of the first cam 73. As the upper supporting shaft 98*a* is moved upward, the beginning end BY of the second thread 1*b* is bent and caught between the outside plates 15*a*, 15*b* and the inner plate 15*c*.

Figures 10A, 10B:
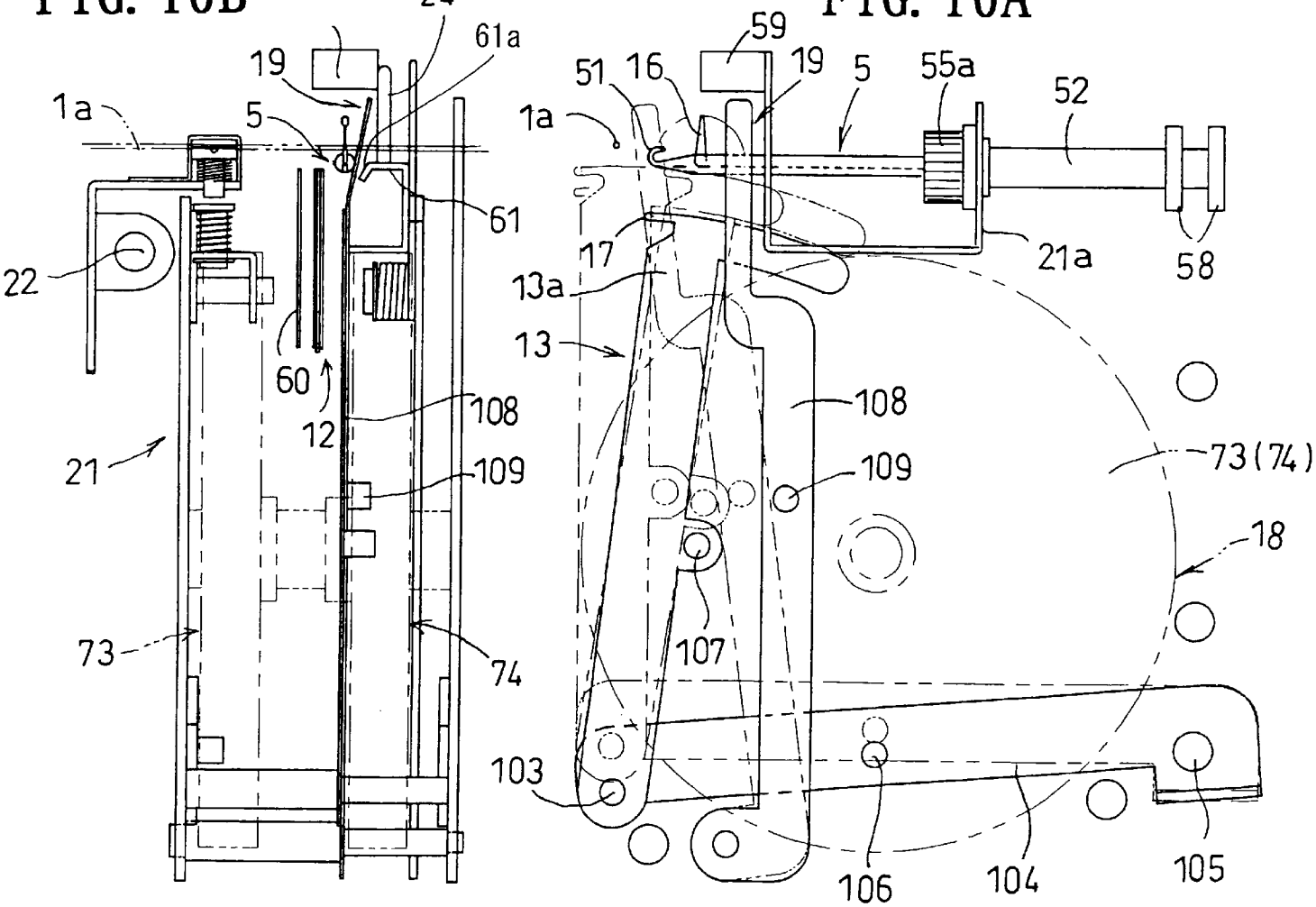
FIG. 10A is a front view showing a first loop control unit, a second thread pressing unit, and an interlock mechanism thereof.
FIG. 10B is a left side view of FIG. 10A.

As shown in FIGS. 10A and 10B, a bottom of a lever 13*a* of the first loop control unit 13 is linked to an end of a loop control lever 104 via a control pin 103 so that the lever 13*a* and the loop control lever 104 are relatively rotatable. A bottom of the loop control lever 104 is pivotally mounted to a supporting shaft 105 of the frame 21. An operating pin 106 of the loop control lever 104 is fitted in the circular cam groove (not shown) formed on the A cam surface 78*a* of the first cam 73. An operating pin 107, positioned in the middle of the lever 13*a*, is fitted in the circular cam groove (not shown) formed on the C cam surface 90*c* of the second cam 74. Thus, in sync with the rotations of the cams 73, 74, the loop control part 17 of the first loop control unit 13 works with the movement of the latch needle 5, so that it moves along the guiding groove 53 of the latch needle 5, and moves downward while getting ahead of the hook 51 of the latch needle 5.

As also shown in FIGS. 10A and 10B, the second thread pressing unit 19 is disposed along one side (close to the thread exit 23) of the periphery of the latch needle 5 and is moved back and forth in the direction of the axis of the latch needle 5. A lever 108, which is flat and elongated vertically, is rotatably supported to the frame 21 at a bottom thereof. A cam pin 109, projecting at substantially a midpoint of the lever 108, is fitted into the circular cam groove (not shown) formed on the C cam surface 90*c* of the second cam 74. An upper portion of the second thread pressing unit 19 is formed of a plate spring. When the lever 108 is pressed leftward via the cam pin 109 at a predetermined time in FIG. 10B, it is elastically urged so that the upper portion is pressed against a side of the latch needle 5. As described later, from the time when the beginning end BY of the second thread 1*b* is inserted into the first loop of the first thread 1*a* to the time when the first loop is tightened, the second thread pressing unit 19 goes between an inclined plane 61*a*, formed at the stand 61 where the thread guides 24 stand, and the side of the latch needle 5, holding the beginning end BY of the second thread 1*b* between the latch needle 5 and the upper portion of the second thread pressing unit 19.

Next, a thread tying process in the thread tying apparatus 2 will be described. When a thread set key 9*b* (FIG. 1) of the switch box 9 is pressed, the thread selection unit 30 is moved to a set position (initial position). Except for a thread used for embroidering first (the first thread 1*a*), threads 1 to be tied coming from the spools 8 set in the spool stand 6 are set in the corresponding thread holding parts 32 of the thread selection unit 30 in advance as shown in FIG. 1. The ends of the threads 1 are cut to the same length so as to project by a predetermined length L1 from a cutter bar 37 (see FIGS. 3 and 6). The length L1 is a minimum length required for tying threads. By cutting the threads to even their ends in advance, excess thread ends do not project from the knot after thread tying. Therefore, the clearing of thread scraps, i.e., gathering and discarding thread scraps, can be simplified as compared with a case where excess thread ends are cut after thread tying.

When a thread number on one of thread number keys 9*a* (FIG. 1, six thread number keys in this embodiment) on the switch box 9 is inputted and the threading key 9*c* is pressed, the thread holding part 32 corresponding to the thread number is disposed at the thread supply position A (FIG. 11A). The first thread 1*a* coming from the spool stand 6 is manually threaded on the embroidery machine 10 at the thread supply position A through the thread exit 23, and the embroidery machine 10 is run to perform embroidering. In this condition, as shown in FIGS. 11A to 11D, the latch needle 5 is stopped at a position retracted slightly to the right of the thread supply position A, and the hook 51 and the latch 16 face upward. Therefore, the latch 16, attracted by the force of the magnet 59, is greatly separated from the hook 51 and set to a standing position (FIG. 11B). The first loop control unit 13 is positioned under the latch needle 5.

To tie threads, the embroidery machine 10 is stopped for a time, a thread number, indicating the second thread 1*b*, is selected from the thread number keys 9*a* on the switch box 9, and the execute key 9E is pressed. By doing so, the thread tying operation is automatically started.

Figure 22B:
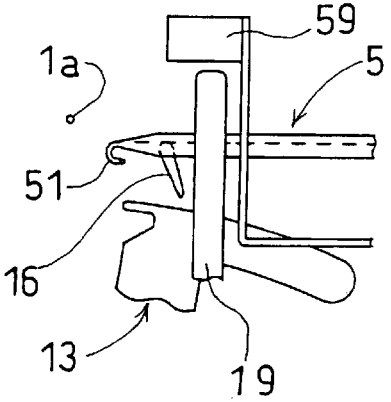
FIG. 22B is a front view showing the state of the latch needle and neighboring parts.
Figure 22C:
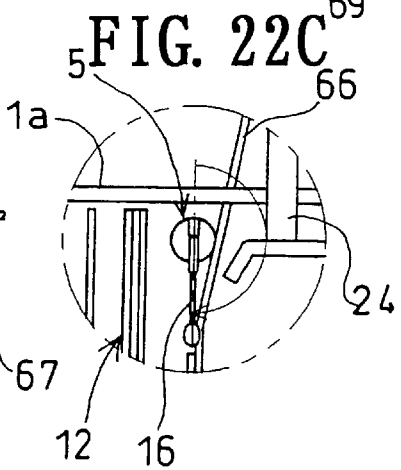
FIG. 22C is an enlarged side view showing only essential parts.
Figure 22D:
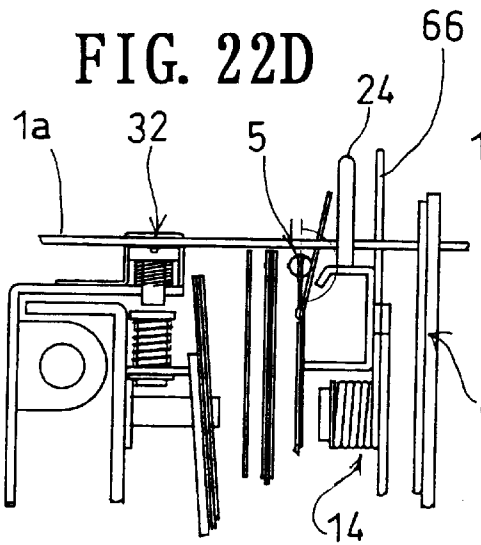
FIG. 22D is a side view of FIG. 22A.

When an appropriate thread number key 9*a* (No. 5 in this embodiment) is pressed, the second driving motor 40 is started. By the action of the interlock mechanism 18, the first thread exit holding unit 67 is activated to hold the first thread 1*a* at the thread exit 23, as understood with reference to FIGS. 18A, 19 and 22A–22B. The thread volume control unit 14 is moved as indicated by double dashed chain line of FIG. 18A, and the spring shaft 66 is moved leftward in FIG. 22A to secure a thread length required for forming the first loop 110 and the second loop 111 for a thread tying, which will be described later. As shown in FIGS. 22B and 22C, the latch needle 5 rotates clockwise when viewed from the tip of the latch needle 5 (from the hook 51 side), and the latch 16 faces down.

Figure 23A:
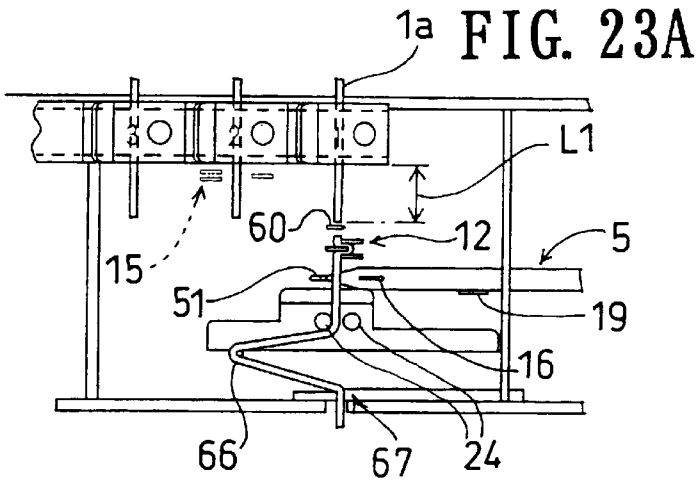
FIG. 23A is a plan view showing that the first thread is about to be caught in the hook for forming the first loop.
Figure 23C:
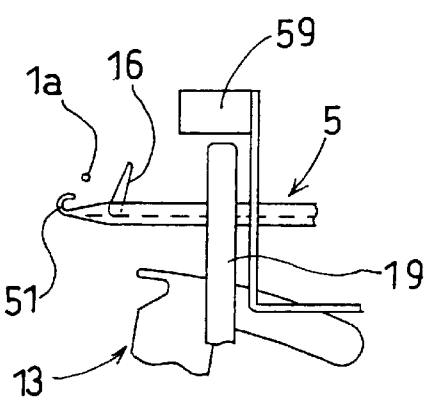
FIG. 23C is a front view showing the state of the latch needle and neighboring parts.
Figure 23B:
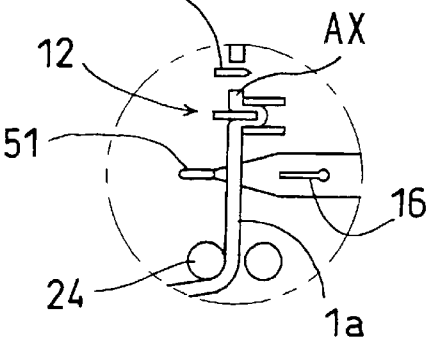
FIG. 23B is an enlarged plan view showing essential parts around the tip of the latch needle.
Figure 23D:
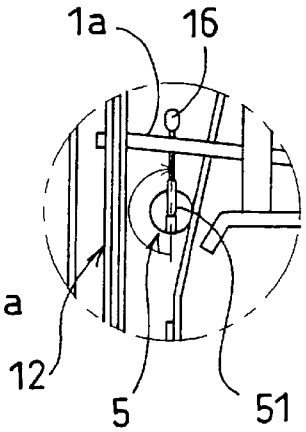
FIG. 23D is an enlarged side view showing the state when the latch needle is rotated.
Figure 23E:
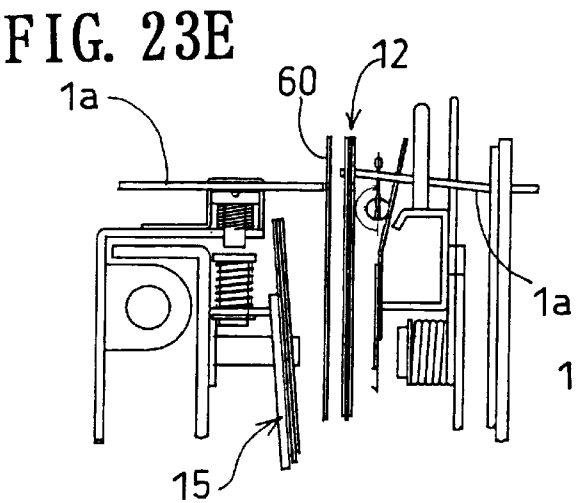
FIG. 23E is a side view of FIG. 23A.

The first driving motor 39 is started, causing the thread selection unit 30 to move to right so as to set the second thread 1*b* to position B as shown in FIG. 24A. Then, the second driving motor 40 is started again, as shown in FIGS. 23A and 23B, the first thread holding member 12 is activated, and the pair of outside plates 12*a*, 12*b* and the inner plate 12*c* come close to each other toward the thread holding part 32 (FIGS. 12, 13). The first thread 1*a* is pressed and held between the ends of the three plates, and the first thread 1*a* is cut off in a position close to the thread holding part 32 by the first thread cutter 60. At this time, the length of the first thread 1*a* projecting from the thread holding part 32 is L1, which is equal to a cut length at the cutter cover 37, to prevent an excess thread end when the thread is used as the second thread to be tied later. Concurrent with the thread cutting, the first thread holding member 12 is raised, and the held first thread 1*a* is displaced to a position higher than the hook 51 of the latch needle 5. The latch needle 5 moves forward while rotating 180 degrees clockwise as shown in FIG. 23D, disposing the first thread 1*a* between the hook 51 and the latch 16 facing upward (FIG. 23C).

Figure 24B:
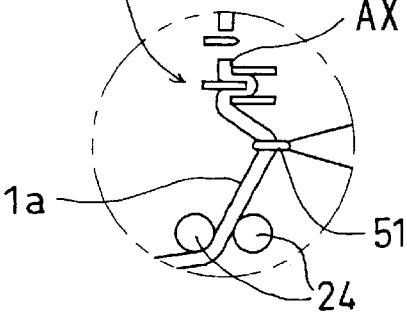
FIG. 24B is an enlarged plan view showing essential parts around the tip of the latch needle.
Figure 24C:
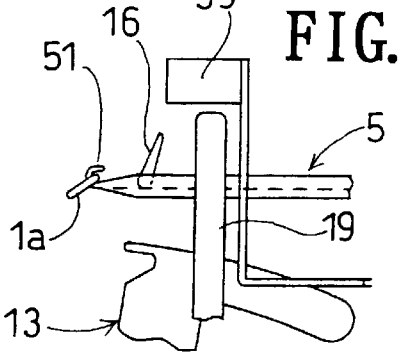
FIG. 24C is a front view showing the state of the latch needle and neighboring parts.
Figure 24D:
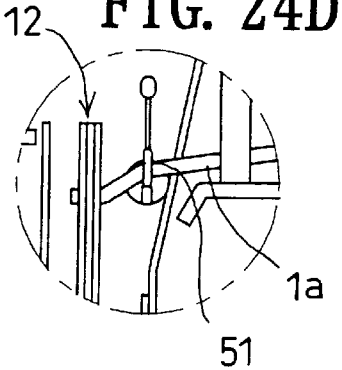
FIG. 24D is an enlarged side view showing the posture of the latch needle.
Figure 24E:
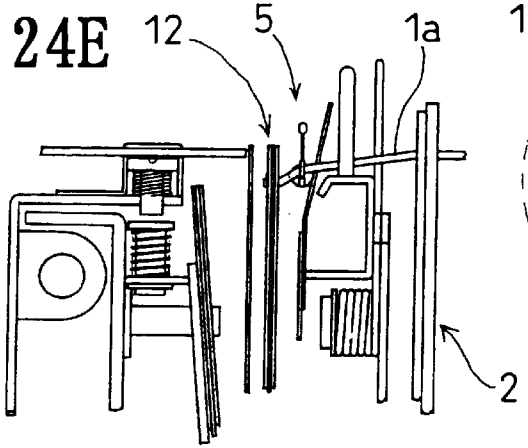
FIG. 24E is a side view of FIG. 24A.

As shown in FIG. 24E, when the first thread holding member 12 is lowered, the latch needle 5 is moved backward so that the first thread 1*a* is brought into intimate contact with the hook 51 (FIGS. 24A to 24C) with the tail end AX of the first thread 1*a* below the hook 51.

Figure 25D:
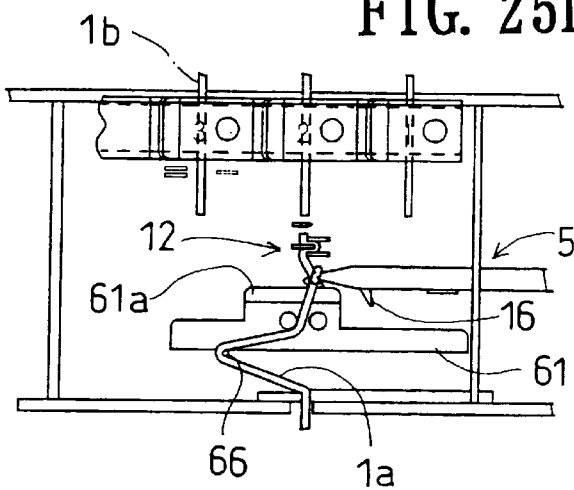
FIG. 25D is a plan view showing that the first thread is twisted by the hook for forming the first loop.
Figure 25E:
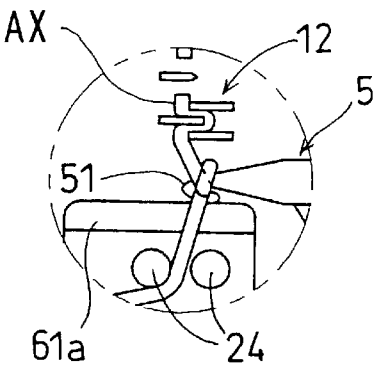
FIG. 25E is an enlarged plan view showing essential parts of FIG. 25D.
Figure 25A:
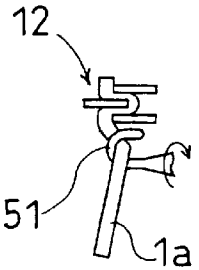
FIG. 25A is an enlarged view showing that the first thread starts to be twisted by the hook for forming the first loop.
Figure 25B:
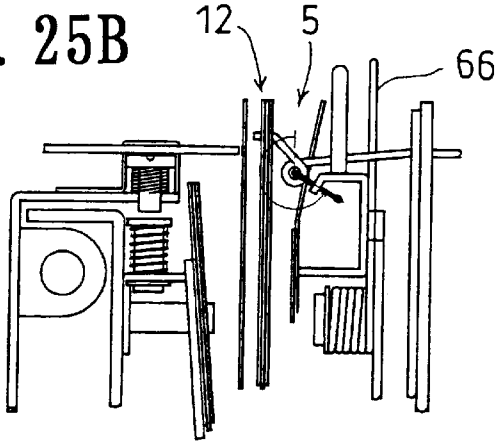
FIG. 25B is a side view showing that the first thread is twisted by the hook for forming the first loop.
Figure 25C:
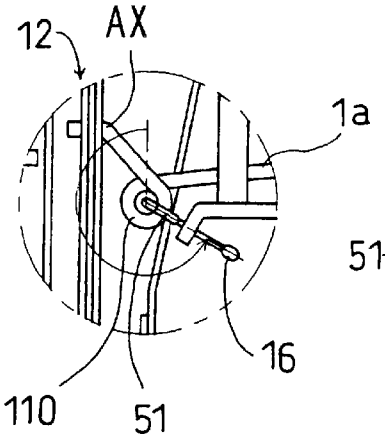
FIG. 25C is an enlarged side view showing only essential parts of FIG. 25B.
Figure 25F:
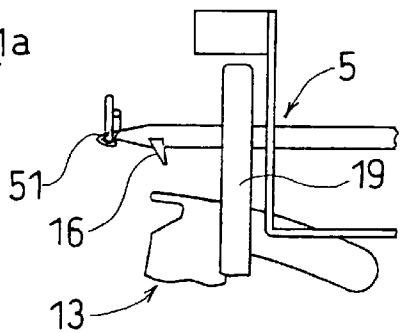
FIG. 25F is a front view showing the state of the latch needle and neighboring parts.

As shown in FIGS. 25A to 25F, the latch needle 5 is rotated 240 degrees counterclockwise from the position of FIG. 24E, to make the first loop 110. FIG. 25A is an enlarged view illustrating the latch needle 5 at the beginning of the rotation. At this time, the first thread holding member 12 is moved upward, and the tail end AX of the first thread 1*a* is positioned higher than the axis of the latch needle 5, allowing the first loop 110 to be moved toward a root of the hook 51 without leaving the hook 51 (FIG. 25B).

Figure 26B:
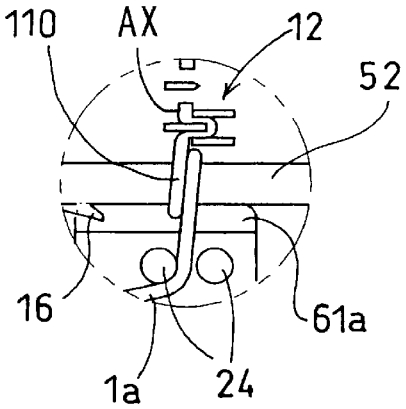
FIG. 26B is an enlarged plan view showing the first loop wound on the stem of the latch needle.
Figure 26A:
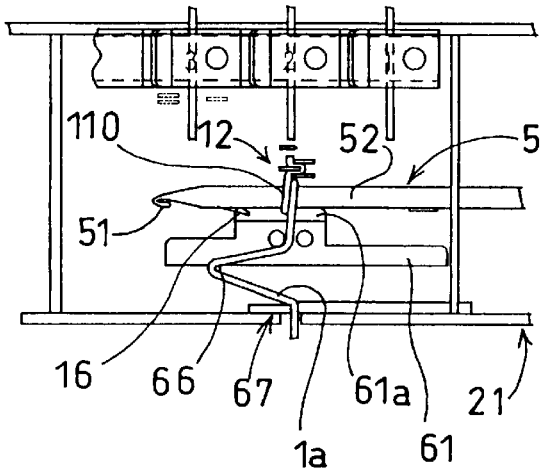
FIG. 26A is a plan view showing that the first loop is made.

Leaving the latch needle 5 in a position rotated 240 degrees counterclockwise as mentioned above, the latch needle 5 is moved ahead as shown in FIG. 26A. The tail end AX of the first thread 1*a* is held by the first thread holding member 12. The other side (toward the machine side) is held by the first thread exit holding unit 67 and positionally controlled by the thread guides 24 while being urged by the spring shaft 66 of the thread volume control unit 14. When the latch needle 5 moves ahead, the first loop 110 moves over the tip of the latch 16 toward the stem 52 while expanding its diameter. At this time, the tip of the latch 16 is slid on the inclined plane 61*a* of the stand 61 so that it should not be closed toward the hook 51 (FIG. 26B).

The first thread holding member 12 is lowered and the latch needle 5 is retracted in such a manner that an intersecting point 110*a* of the first loop 110 is separated from the latch 16 while the latch 16 remains controlled so as not to close at the inclined plane 61*a* as mentioned above. As shown in FIGS. 27B to 27D, the first loop 110 is wound around the stem 52, a thread portion heading toward the first thread holding member 12 is positioned under the latch 16 (toward the stem 52, or also referred to as outside the latch 16 because when the latch 16 is closed to the hook 51 in circularity later, the thread is to be positioned outside circularity of the hook 51). On the other hand, a thread portion of the first loop 110 heading toward the thread guides 24 is positioned over the latch 16 (also referred to as inside the latch 16 because when the latch 16 is closed to the hook 51 in circularity later, the thread is to be positioned inside the latch 16). At this time, the first thread 1*a* is elastically urged by the spring shaft 66 of the thread volume control unit 14, thereby tightly winding the first loop 110 around the stem 52 without any looseness. Therefore, when the latch needle 5 is moved back, the tip of the latch 16 does not go into nor stick into the first loop 110. In addition, because the latch needle 5 is kept in a position where it has been rotated 240 degrees, the latch 16 is separated approximately 120 degrees from the intersecting point 110*a* of the first loop 110 and approximately 30 degrees from a midpoint of the first thread 1*a*. The stand 61 is positioned so that it is away from the midpoint of the first thread 1*a*. As the latch needle 5 is moved back under the condition where the tip of the latch 16 is controlled at the inclined plane 61*a* of the stand 61, the tip of the latch 16 passes under the first thread 1*a*. Therefore, the tip of the latch 16 does not stick into nor pass over the first thread 1*a*. Later thread tying processes can be performed stably.

Figure 27A:
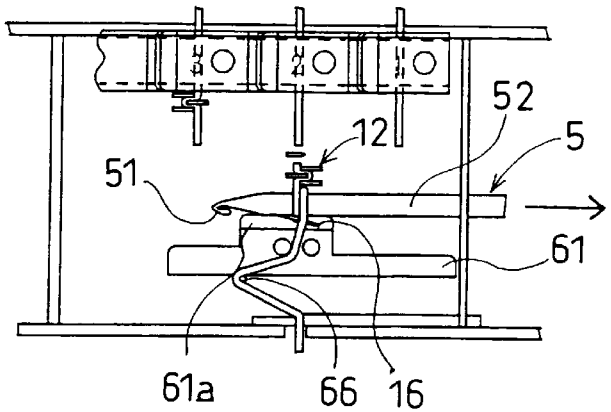
FIG. 27A is a plan view showing that the first loop is about to be over the hook for forming a second loop (first phase)
Figure 27B:
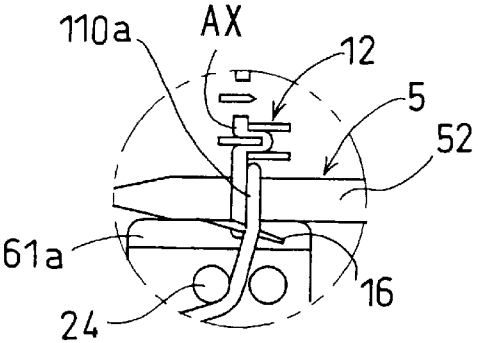
FIG. 27B is an enlarged plan view showing the posture of the latch.
Figure 27C:
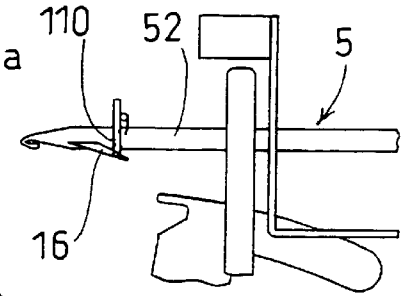
FIG. 27C is a front view showing the state of the latch needle and neighboring parts.
Figure 27D:
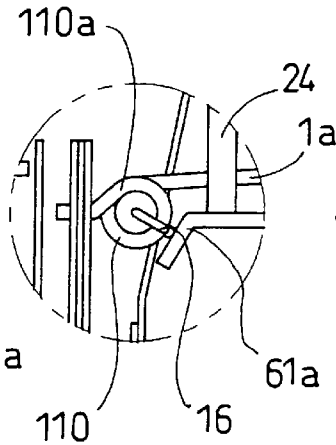
FIG. 27D is an enlarged side view showing the posture of the latch needle.
Figure 27E:
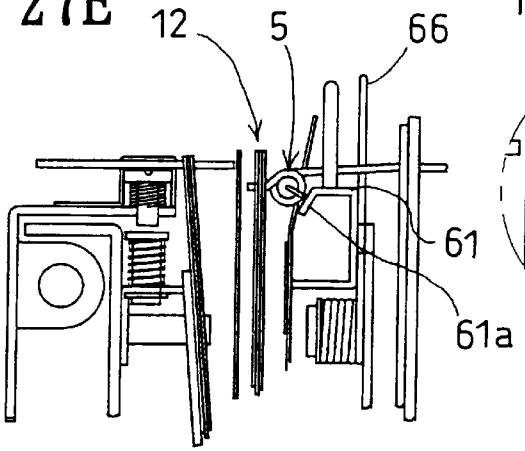
FIG. 27E is a side view of FIG. 27A.
Figures 28A, 28B, 28C, 28D, 28E:
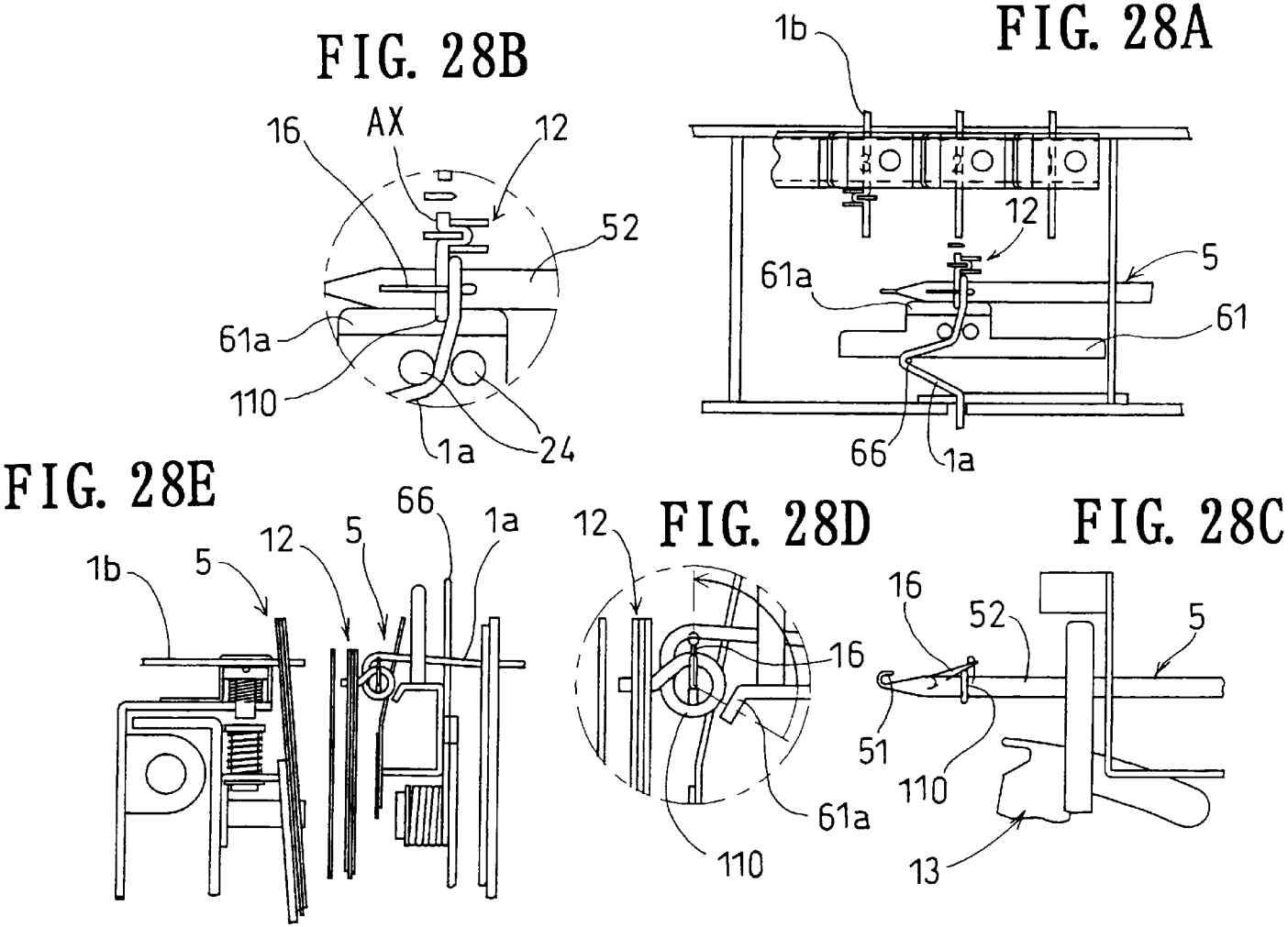
FIG. 28A is a plan view showing that the first loop is about to be over the hook for forming the second loop (second phase)
FIG. 28B is an enlarged plan view showing the posture of the latch.
FIG. 28C is a front view showing the state of the latch needle and neighboring parts.
FIG. 28D is an enlarged side view showing the posture of the latch needle.
FIG. 28E is a side view of FIG. 28A.

The latch needle 5 is stopped to move back at a position shown in FIG. 27A, and rotated an additional 120 degrees counterclockwise as shown in FIG. 28D, so that the latch 16 and the hook 51 face upward. During this process, as shown in FIG. 28B, one side of the first loop 110 (the thread portion heading toward the first thread holding member 12) is disposed outside the latch 16 at the periphery of the stem 52 near the root of the latch 16. The other side of the first thread 110 (the thread portion heading toward the thread guides 24) is disposed inside the latch 16, it passes over the latch 16.

Figure 29A:
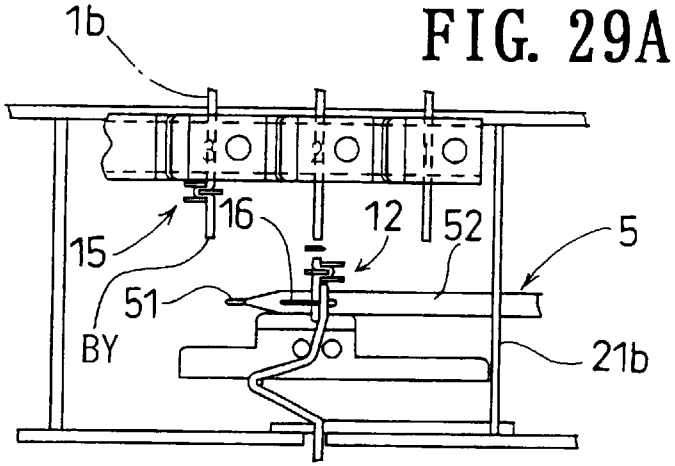
FIG. 29A is a plan view showing that the first loop is about to be over the hook for forming the second loop (third phase)
Figure 29B:
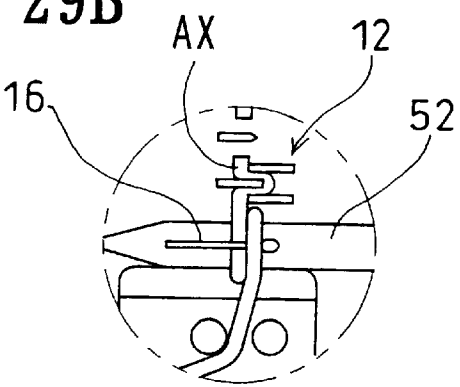
FIG. 29B is enlarged plan view showing the posture of the latch.
Figure 29C:
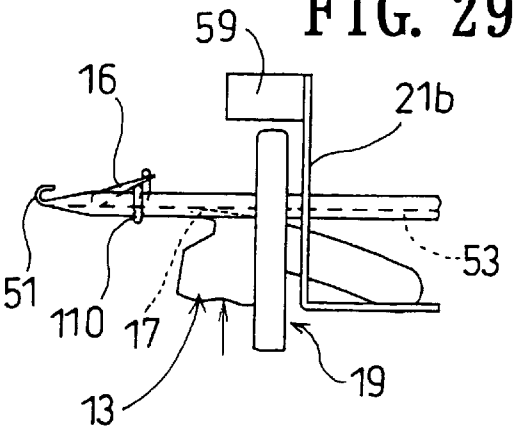
FIG. 29C is a front view showing the state of the latch needle and neighboring parts.
Figure 29D:
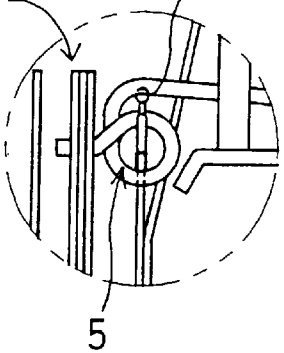
FIG. 29D is an enlarged side view showing the posture of the latch needle.
Figure 29E:
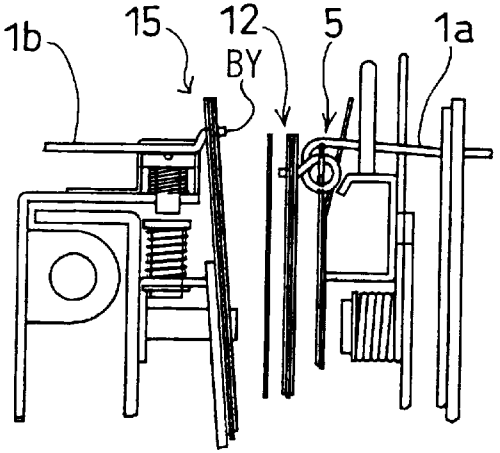
FIG. 29E is a side view of FIG. 29A.
Figure 30:
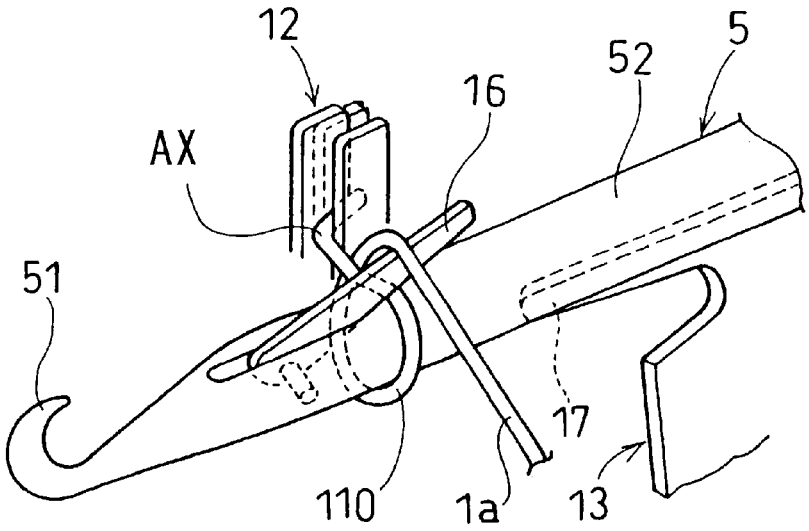
FIG. 30 is an enlarged perspective view showing the first loop is divided by the latch.

Next, the beginning end BY of the second thread 1*b* is maintained by the second thread holding member 15 (FIGS. 29A, 29E). Nearly concurrently with this operation, the loop control part 17 of the first thread control unit 13 is raised so as to fit in the guiding groove 53 provided on the underside of the latch needle 5. The raised position is behind the first loop 110 toward the root of the stem 52 (FIGS. 29C, 30). The first loop control unit 13 is controlled by a guide groove (not shown) formed in the partition wall 21*b* when it is raised, ensuring that the loop control part 17 is fitted into the guiding groove 53.

Figure 31A:
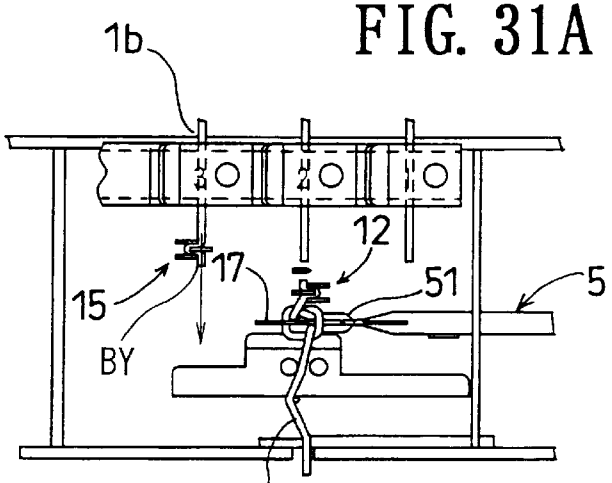
FIG. 31A is a plan view showing that the second loop is made (the first loop is over the hook)
Figure 31B:
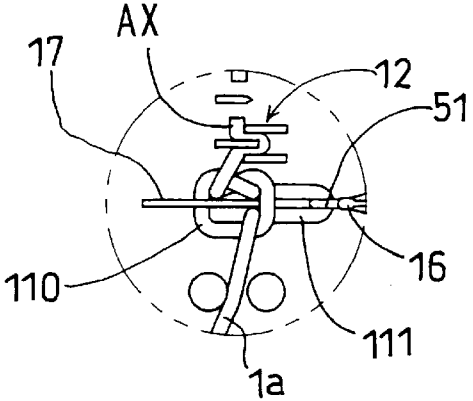
FIG. 31B is an enlarged plan view showing the first loop and the second loop at the tip of the latch needle.
Figure 31C:
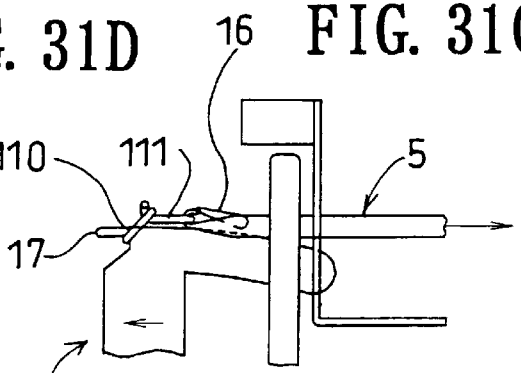
FIG. 31C is a front view showing the state of the latch needle and neighboring parts.
Figure 31D:
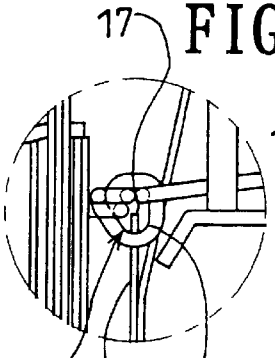
FIG. 31D is an enlarged side view showing the posture of the latch needle.
Figure 31E:
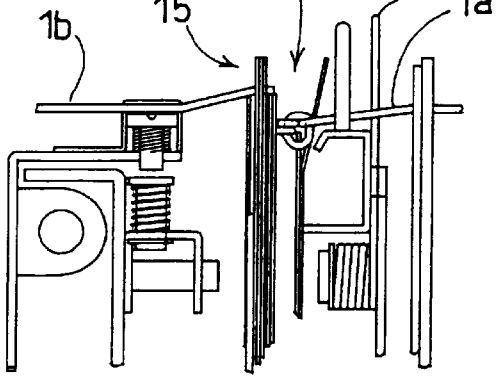
FIG. 31E is a side view of FIG. 31A.
Figure 32:
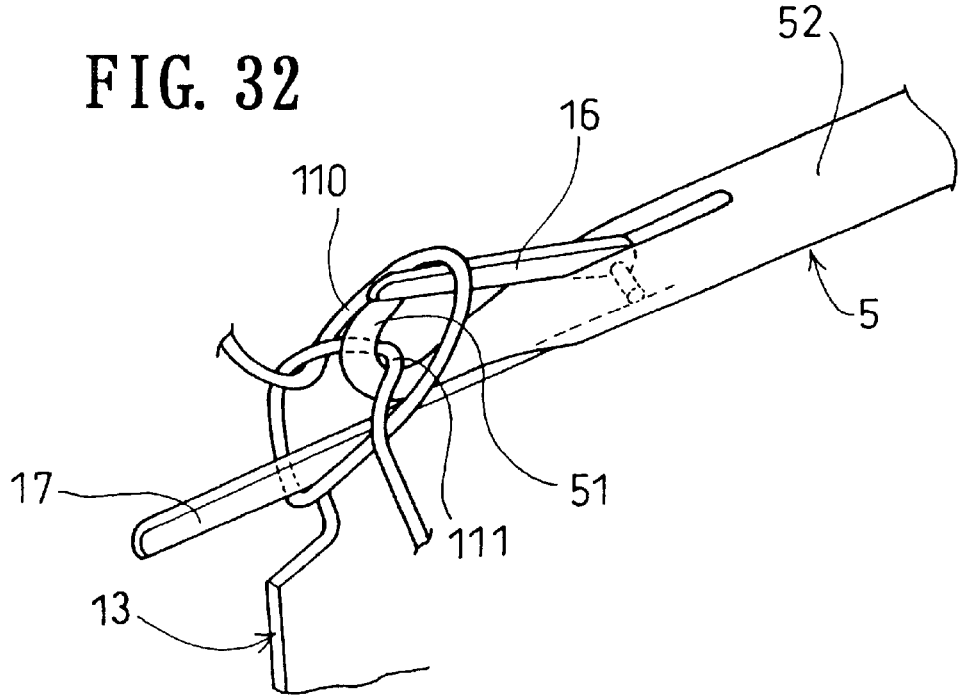
FIG. 32 is an enlarged perspective view showing the second loop is made from the first loop.
Figure 33:
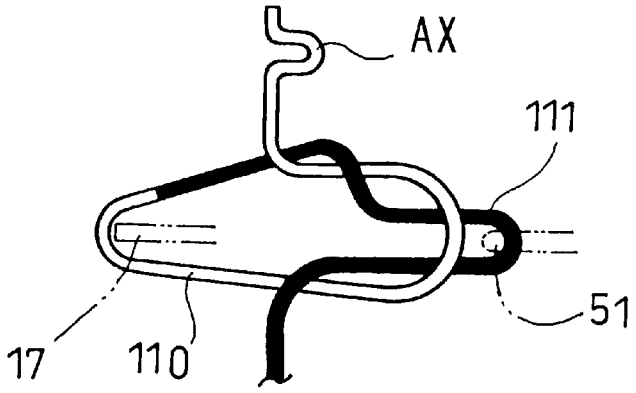
FIG. 33 is an enlarged plan view showing the placement of the first loop and the second loop.

When the latch needle 5 is retracted as shown in FIGS. 31A, 31C, the tip of the loop control part 17 that is moved forward relatively goes into the first loop 110 from the underside of the stem 52 and a lower part of the first loop 110 is restrained at the root of the loop control part 17. After the latch 16 stands by means of the first loop 110, the tip of the latch 16 makes contact with the hook 51, closing the hook 51. By doing this, the thread portion inside the latch 16 is disposed in the hook 51, and the thread portion outside the latch 16 comes off from outside the hook 51. As a result, as shown in FIGS. 31B, 32, and 33, the thread passes into the first loop 110, thereby forming the second loop 111. The two loops 110, 111 are shaped like the number 8, in other words, the second loop 111 extends in a direction opposite to a direction the first loop 110 extends. To make clear how the loops are formed, the loops are illustrated loosely in FIGS. 32, 33. Concurrently with the formation of the second loop 111, the second thread holding member 15 holding the beginning end BY of the second thread 1*b* is moved forward toward the stand 61 (FIG. 31A).

Figures 34A, 34B, 34C, 34D, 34E:
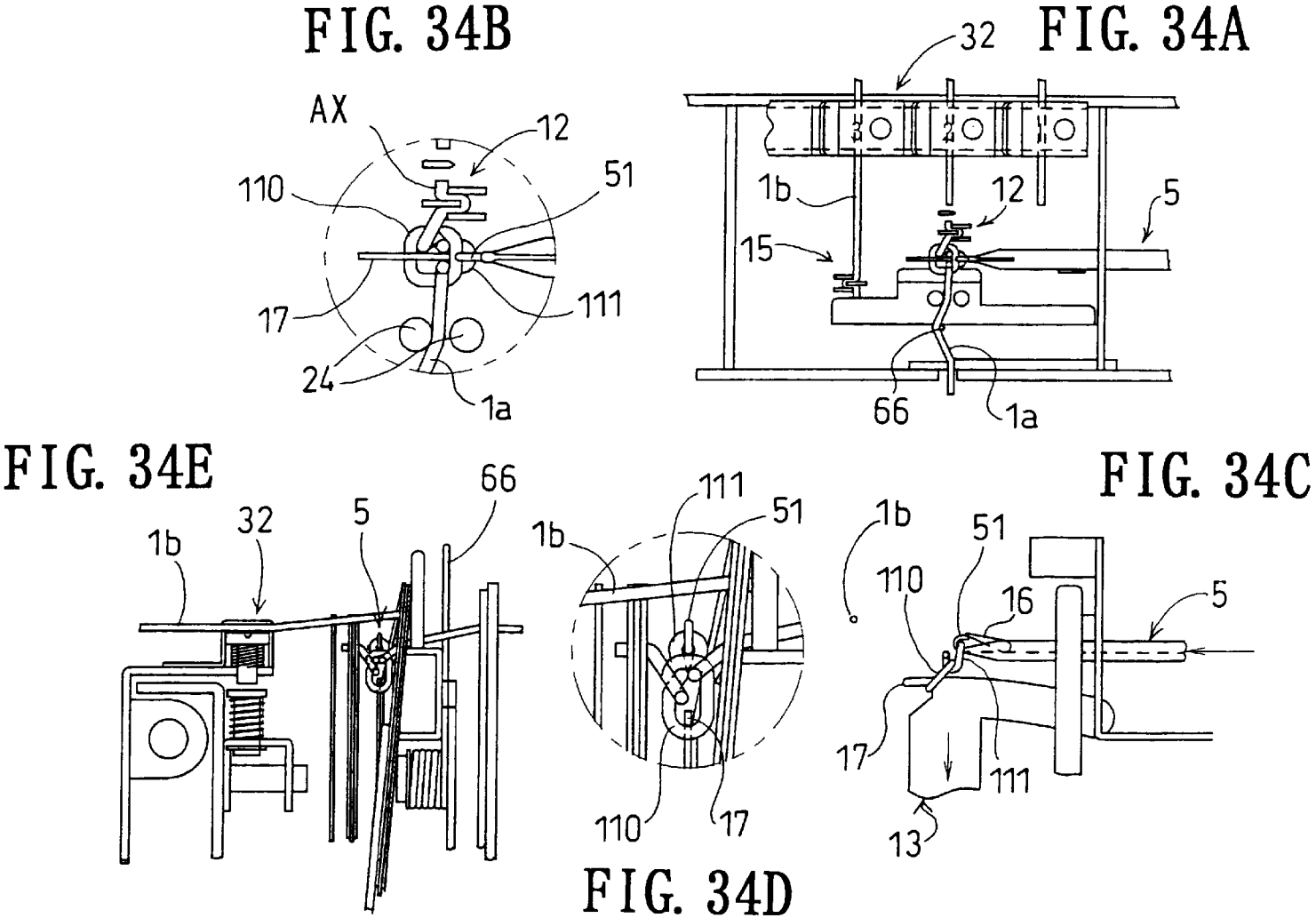
FIG. 34A is a plan view showing that the second loop is about to be over the hook for tying the second thread to the first thread (first phase)
FIG. 34B is an enlarged plan view showing the first loop and the second loop at the tip of the latch needle.
FIG. 34C is a front view showing the state of the latch needle and neighboring parts.
FIG. 34D is an enlarged side view showing the posture of the latch needle.
FIG. 34E is a side view of FIG. 34A.

When the first thread loop control unit 13 is lowered against the latch needle 5 (FIG. 34C), the second loop 111 is pulled downward vertically via the first loop 110. When the latch needle 5 is moved forward with this condition, the second loop 111 goes toward the stem 52 without coming off from the hook 51 (FIGS. 35A, 35C). In order that the midpoint of the second thread 1*b* may be positioned above the latch needle 5 (FIG. 34E), while the second thread holding member 15 is moved forward toward the stand 61, the second thread movable member 94 is moved as shown in FIG. 16, second thread holding levers 100*a*, 100*b* are moved upward, and the second thread 1*b*, maintained at the second thread holding member 15, is raised (FIGS. 34C to 34E).

As shown in FIG. 35A, when the latch needle 5 is moved forward, the second loop 111 on the hook 51 side tilts the latch 16 and moves toward the stem 52. In this case, to expand the second loop 111, the thread volume control unit 14 is activated slightly, allowing the spring shaft 66 to move to a line connecting the thread guides 24 and the thread exit 23, and an urge force applied to the first thread 1*a* (or a tension applied to the first thread 1*a*) is reduced (FIG. 35A). The urge force that the spring shaft 66 of the thread volume control unit 14 applies to the thread is reduced before the second loop 111 is formed.

After the hook 51 of the latch needle 5 passes under the second thread 1*b*, the second thread 1*b* is disposed within a range that the latch 16 moves and rotates (FIG. 35C), ensuring that the second thread 1*b* can be caught in the hook 51 at the next process when the latch 16 closes to the hook 51 and the latch needle 5 rotates. As shown in FIGS. 36A, 36B, the latch needle 5 is moved forward until the hook 51 passes the second thread 1*b* from underneath and the latch 16 does not pass by, and the second thread holding member 15 is lowered (FIG. 36E).

Figure 20:
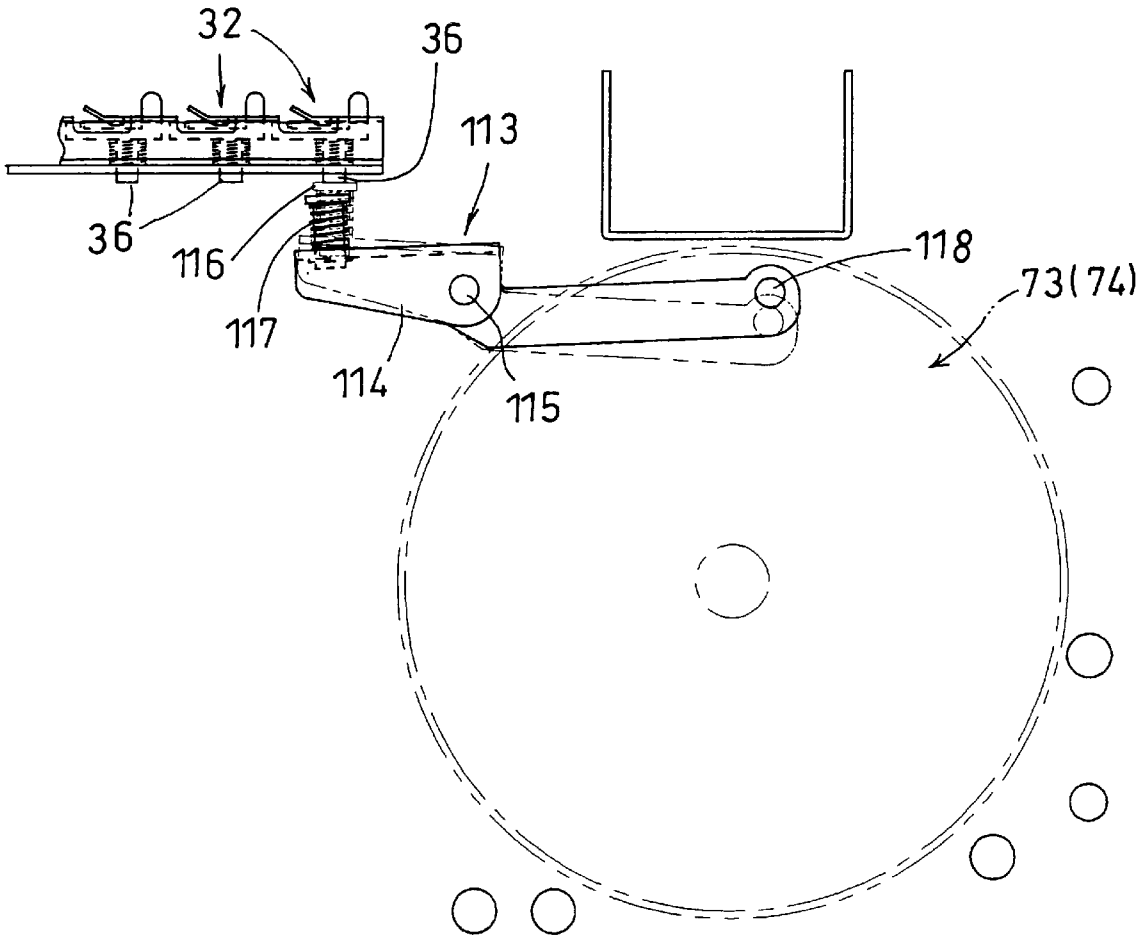
FIG. 20 is a front view of a second thread way in the holding unit at a thread tying position.
Figure 21:
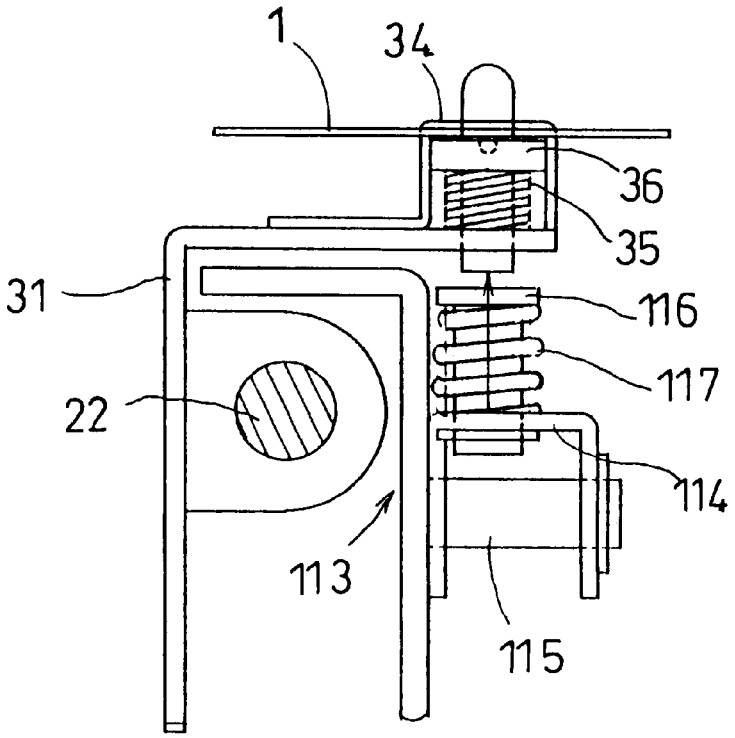
FIG. 21 is an enlarged side view showing essential portion of the second thread way in the holding unit.

As shown in FIGS. 37A to 37E, when the latch needle 5 is moved back, the midpoint of the second thread 1*b* is pulled and bent by the hook 51 in a substantially L shape in the top view, to keep the beginning end BY of the second thread 1*b* to a minimum length, that which is required just for thread tying. At this time, the second loop 111 comes close to the root of the latch 16, causing the latch 16 to close to the hook 51. Then, as shown in FIGS. 20, 21, 38A to 38E, the pressing member 36 is strongly urged at a second thread way in holding unit 113, so as to maintain the second thread 1*b*, which has been drawn out, securely at the thread holding part 32 (a way in side). In other words, as shown in FIG. 20, a horizontal lever 114 is pivoted to the frame 21 via a shaft 115. At one end of the lever 114, an additional pressing member 116, that presses the pressing member 36 of the thread holding part 32 up from the bottom, is mounted via a spring 117 so as to be movable vertically. A cam pin 118, which projects at another end of the lever 114, is fitted in a circular cam groove (not shown) formed on the A cam surface 78*a* of the first cam 73. Therefore, in accordance with the operation of the interlock mechanism 18, the second thread 1*b* is strongly held at the side where the second thread 1*b* enters (at the side of the thread holding part 32) so that it is not dragged out during and after the process illustrated in FIG. 38.

Figures 38A, 38B, 38C, 38D, 38E:
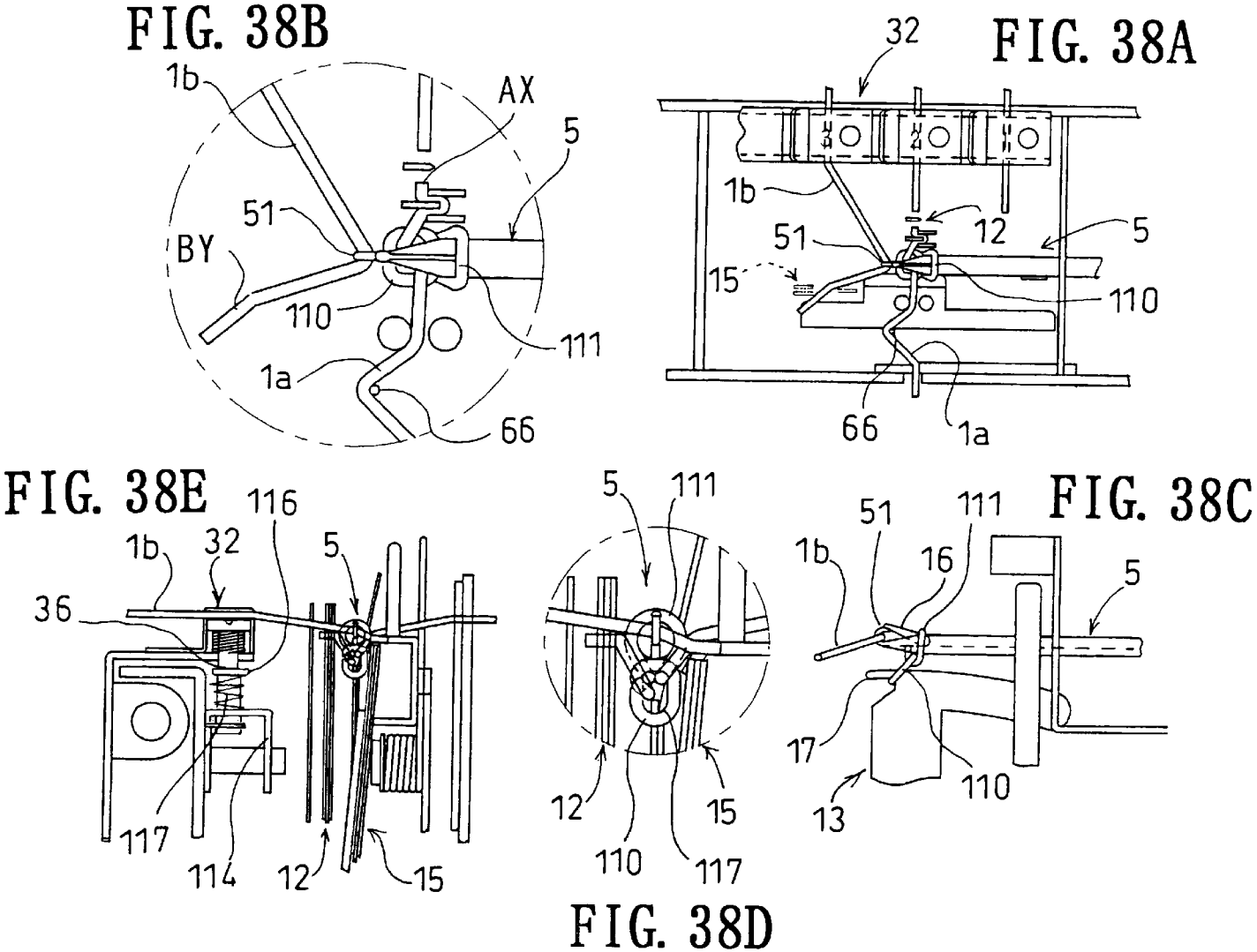
FIG. 38A is a plan view showing that the second thread is caught in the hook and the beginning end of the second thread is released for tying the second thread to the first thread.
FIG. 38B is an enlarged plan view showing the relationship between the first loop, the second loop and the second thread near the hook.
FIG. 38C is a front view showing the state of the latch needle and neighboring parts.
FIG. 38D is an enlarged side view showing the posture of the latch needle.
FIG. 38E is a side view of FIG. 38A.
Figure 39A:
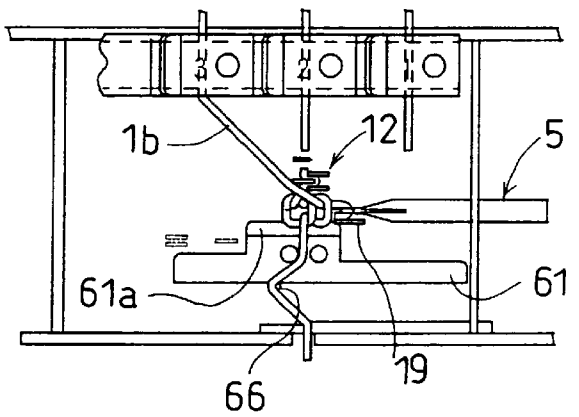
FIG. 39A is a plan view showing the beginning end of the second thread caught in the hook, pulled into the second loop, and held by the thread pressing unit for tying the second thread to the first thread.
Figure 39B:
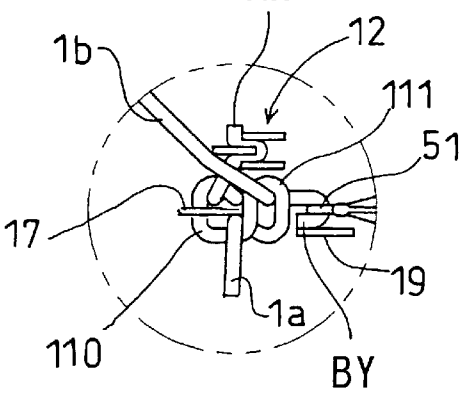
FIG. 39B is an enlarged plan view showing the relationship between the first loop, the second loop and the second thread near the hook.
Figure 39C:
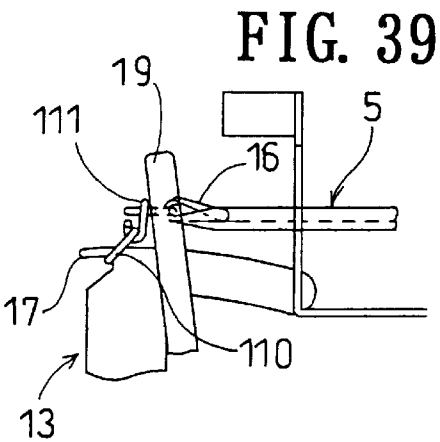
FIG. 39C is a front view showing the state of the latch needle and neighboring parts.
Figure 39D:
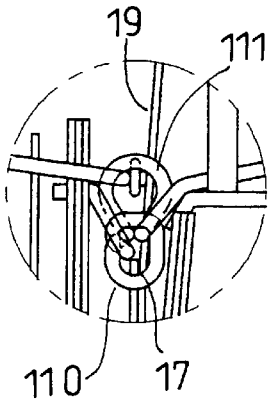
FIG. 39D is an enlarged side view showing the posture of the latch needle.
Figure 39E:
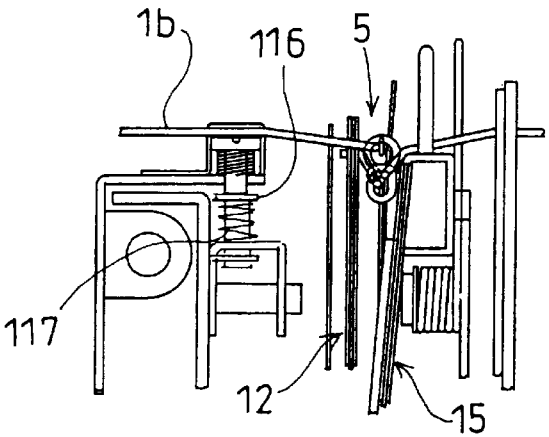
FIG. 39E is a side view of FIG. 39A.
Figure 40A:
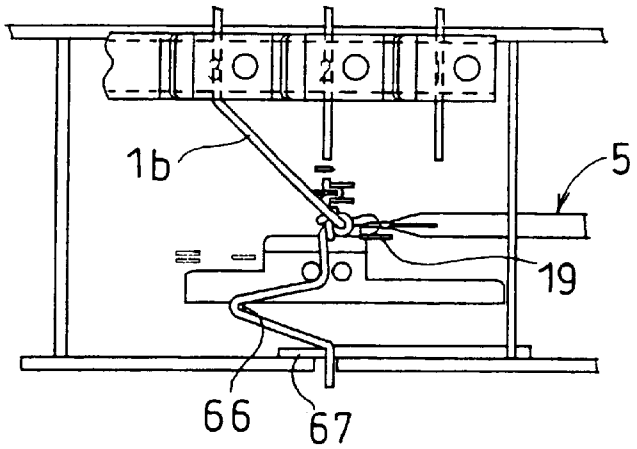
FIG. 40A is a plan view showing the beginning end of the second thread caught in the hook, pulled into the second loop, held by the thread pressing unit, and the loop diameter is reduced for tying the second thread to the first thread.
Figure 40B:
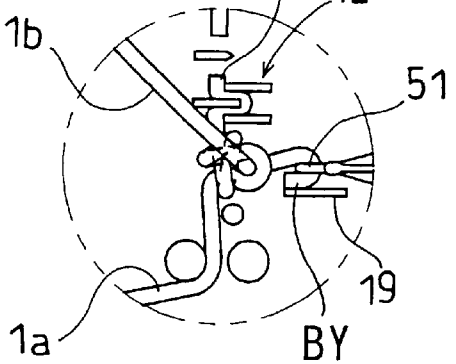
FIG. 40B is an enlarged plan view showing the relationship between the first loop, the second loop and the second thread near the hook.
Figure 40C:
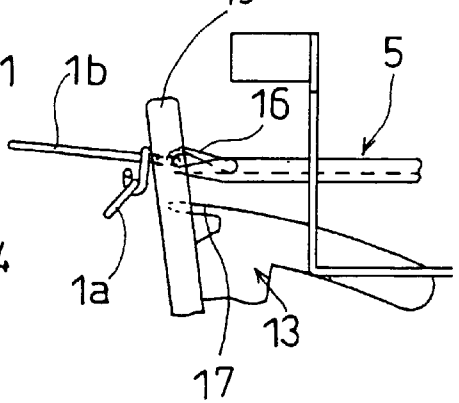
FIG. 40C is a front view showing the state of the latch needle and neighboring parts.
Figure 40D:
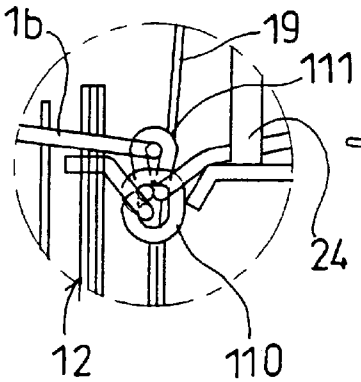
FIG. 40D is an enlarged side view showing the posture of the latch needle.
Figure 40E:
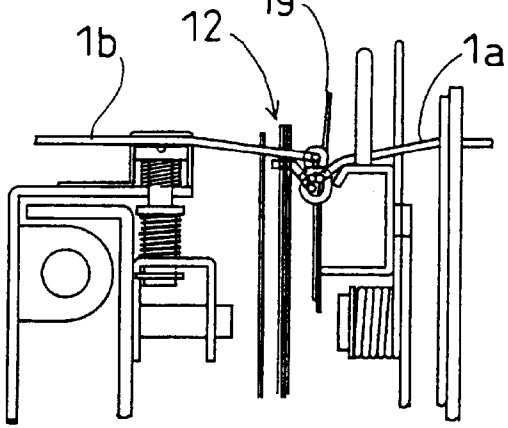
FIG. 40E is a side view of FIG. 40A.

Under this condition, the second thread holding member 15 is operated (the outside plates 15*a*, 15*b*, and the inner plate 15*c* are set apart at their ends), and the beginning end BY of the second thread 1*b* is released (FIG. 38B). As shown in FIGS. 39A to 39C, when the latch needle 5 further retracts, the second loop 111 exits from the hook 51 because the first loop 110 can not move back under the control of the first loop control unit 13. As a result, the beginning end BY of the second thread 1*b*, which is temporarily maintained at the hook 51, can be inserted into the second loop 111 (FIG. 39B). At this time, the second thread pressing unit 19, which is positioned on the side of the stem 52, is inserted between the inclined plane 61*a* and the beginning end BY of the second thread 1*b*, to fix the beginning end BY (FIGS. 39A, 39B).

While the beginning end BY of the second thread 1*b* is retained by the second thread pressing unit 19 as shown in FIGS. 40A to 40E, the loop control part 17 of the first loop control unit 13 is moved back so that it can be released from the first loop 110 (FIG. 40C), and the thread volume control unit 14 is activated again to press the spring shaft 66 against the first thread 1*a*, giving the tensile force. That is, as mentioned above, the first thread 1*a* is caught by the first thread exit holding unit 67 at the exit side and by the first thread holding member 12 at the tail end AX of the first thread 1*a*, and the latch needle 5 and the first loop control unit 13 are disconnected from the second loop 111 and the first loop 110. Therefore, when the thread volume control unit 14 is activated, the diameters of the second loop 111 and the first loop 110 become small, fixing the second thread 1*b* in the small diameter of the second loop 111.

The second thread pressing unit 19 may fix the beginning end BY of the second thread 1*b* near the thread holding part 32. When the thread volume control unit 14 applies the tension to the first thread 1*a*, the tail end AX of the first thread 1*a* (which is in the first loop 110 and the second thread 111) is pulled toward the edge of the inclined plane 61*a* of the stand 61, and the beginning end BY of the first thread 1*a*is fixed. If the beginning end BY is not continuously fixed until the diameter of the first loop 110 of the first thread 1*a* becomes small, the beginning end BY of the second thread 1*b* pulls out of the second loop 111, and thread tying ends in failure.

As shown in FIGS. 41A to 41E, when the second thread pressing unit 19 is moved back to unfix the beginning end BY of the second thread 1*b* quickly, the beginning end BY of the second thread 1*b* becomes free. As the thread volume control unit 14 continuously gives tension to the first thread 1*a*, the second loop 111 including the second thread 1*b* therein passes into the first loop 110 and returns to a straight line. A loop that passes in the first loop 110 is formed in the second thread 1*b*, and the knot 120 is formed.

Figure 42:
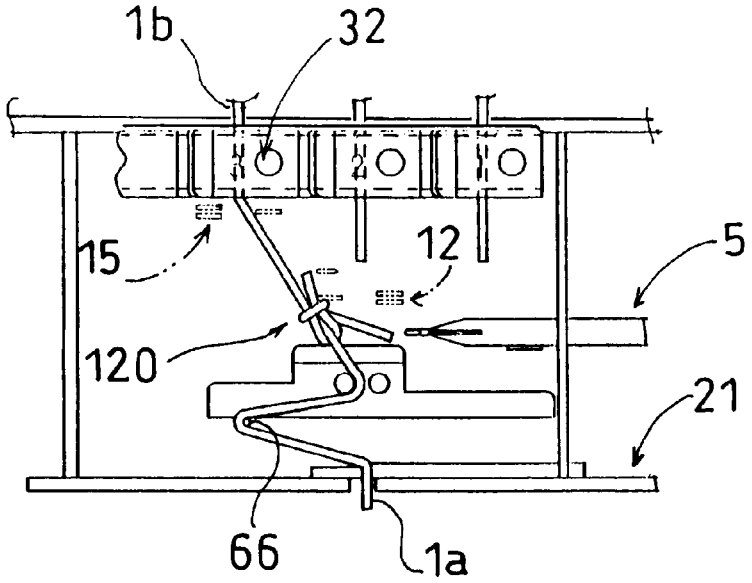
Figure 43B:
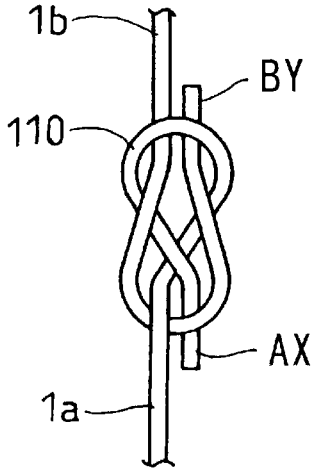
Figure 43C:
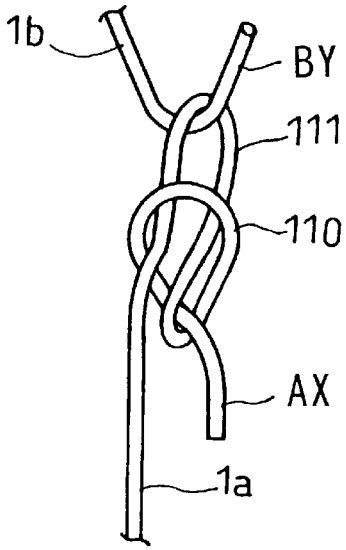
Figure 43A:
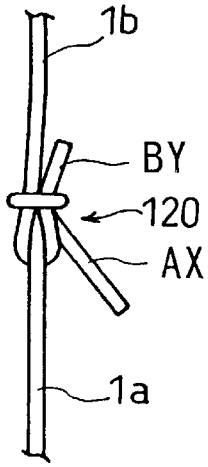

As shown in FIG. 42, when the tail end AX of the first thread 1*a* is unfixed by the first thread holding member 12 with the spring shaft 66 of the thread volume control unit 14 giving tension, the knot 120, which has been positioned on a line connecting the first thread holding member 12 and the thread guides 24, is rapidly moved to the side where the second thread 1*b* enters (near the thread tying position B), causing the frictional resistance between the first loop 110 of the first thread 1*a* and the second thread 1*b* to increase, and the knot 120 to be tightened without coming loose. FIG. 43A is a plan view of the knot 120, FIG. 43B illustrates the loosened knot 120, and FIG. 43C illustrates when the beginning end BY of the second thread 1*b* is inserted into the first loop 110 and the second loop 111 (FIG. 39B) before the knot 120 is made. That is, when the first thread 1*a* is pulled down from the left side of the first thread 1*a* in FIG. 43C (which extends downward), the second loop 111 that temporarily stops the beginning end BY of the second thread 1*b* thoroughly passes through the first loop 110. This situation is illustrated in FIG. 43B.

Figure 44:
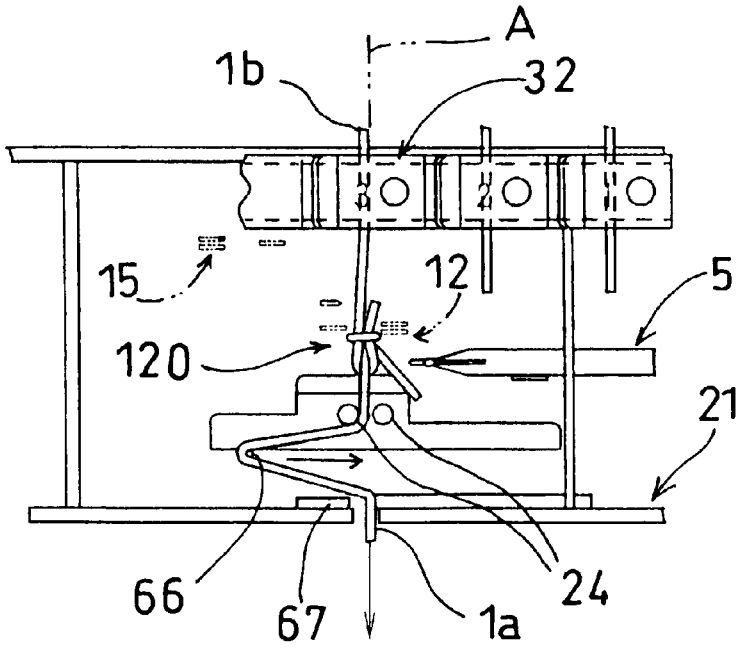

Following the situation in FIG. 42, the tension of the first thread 1*a* is loosened at the first thread exit holding unit 67 at the thread exit 23, the thread selection unit 30 is moved so that the thread holding part 32 of the second thread 1*b* is at the thread supply position A (FIG. 44), the tension applied by the spring shaft 66 of the thread volume control unit 14 is released, and the second thread 1*b* that is tied with the first thread 1*a* by the knot 120, is supplied to the embroidery machine.

Figure 45:
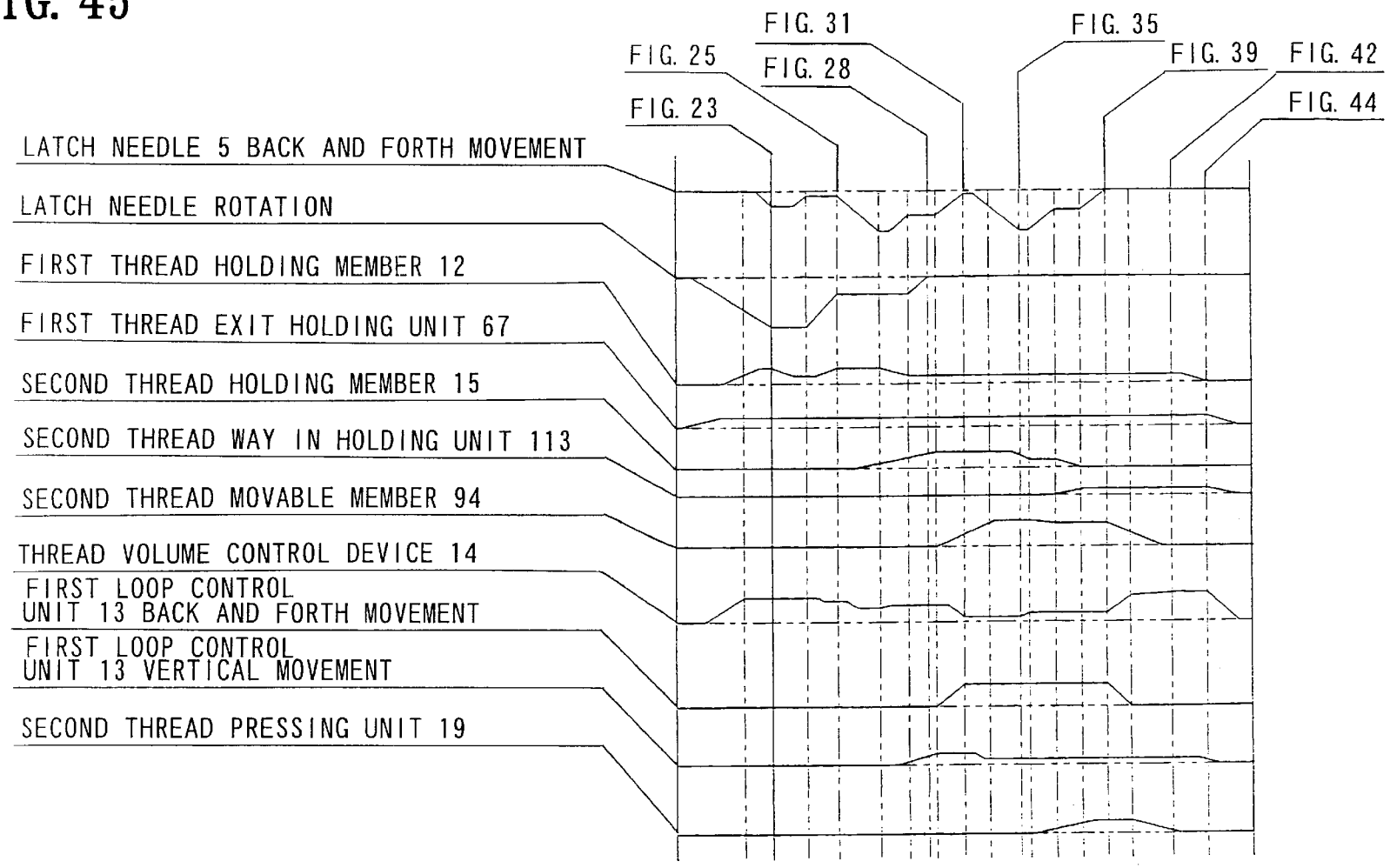

FIG. 45 is a time chart showing an operation status of each member (unit) in the thread tying process. Each vertical axis represents a state illustrated in the corresponding figures. For example, in FIG. 45, the top line graph for the back and forth movement of the latch needle 5 shows a distance where the latch needle 5 is moved forward from the reference position. At the vertical axis of FIG. 35, the latch needle 5 is at the headmost position. The second line graph shows the rotation of the latch needle 5. When the line graph is below the horizontal axis indicating an initial phase (the latch 16 faces up), the latch needle 5 rotates clockwise. That is, at the vertical axis of FIG. 23, it is when the latch needle 5 has rotated 360° clockwise. A line graph for the first thread holding member 12 shows a change of heights where the first thread holding member 12 holds the first thread 1*a*. A line graph for the second thread holding member 15 shows a change of heights where the second thread holding member 15 holds the second thread 1*b*. A line graph for the thread volume control unit 14 shows a movement from the thread supply position A to the thread tying position B. A line graph for the back and forth movement of the first loop control unit 13 shows a distance where the first loop control unit 13 moves forward and backward. A line graph for the vertical movement of the first loop control unit 13 shows a distance where the first loop control unit 13 rises from the lower position (initial position). A line graph for the second thread pressing unit 19 shows duration where the second thread pressing unit 19 is activated.

Figure 46A:
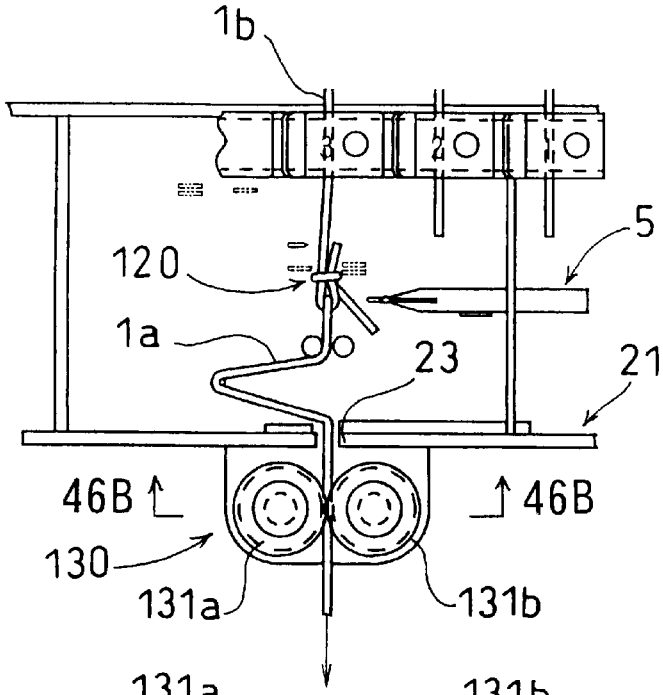
Figure 46B:
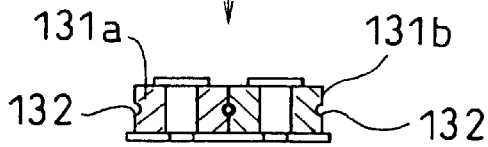
Figure 47:
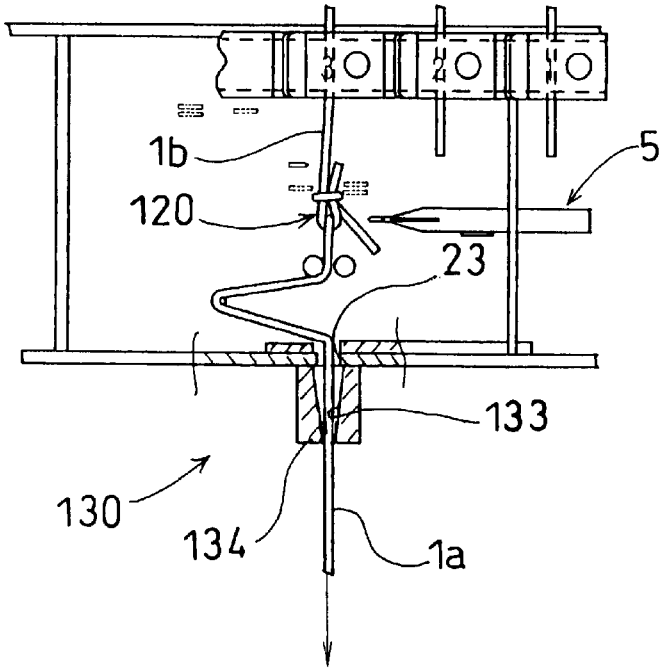

To make the knot 120 still smaller, it is preferable to provide a reducing unit 130 at the thread exit 23 in the frame 21 of the thread tying apparatus 2. As a first embodiment of the reducing unit 130, circular grooves 132 are formed on each circumferential surface of a pair of rollers 131*a*, 131*b*, which make contact with each other, thereby passing the first thread 1*a*, the knot 120, and the second thread in this order through the circular grooves 132 (FIG. 46). In a second embodiment, as shown in FIG. 47, a block 134 including a tapered opening 133 that narrows in a direction that the thread is supplied, is fixed.

The thread tying method and the thread tying apparatus of the invention can be applied to a thread tying operation in various textile machines such as a weaving machine, a knitting machine, and a thread winding machine, in addition to an embroidery machine. The method and unit are applicable to tying of threads, such as a natural fiber, a synthetic fiber, a blended twine, a monofilament, and a metallic fiber.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. A method of tying a first thread and a second thread, comprising the steps of:

making a first loop from the first thread with a tail end portion thereof being held;

making a second loop by passing a portion of the first thread into the first loop while holding the tail end portion of the first thread;

passing a beginning end of the second thread through the second loop; and pulling the second loop out of the first loop.

2. The method according to claim 1, wherein the first loop making step includes winding the first thread substantially around a hook of a latch needle holding the tail end portion of the first thread;

the second loop making step includes making the first loop go over a latch of the latch needle, which is away from the hook, to place the first loop on a stem of the latch needle and place a portion extending from the first loop of the first thread inside the latch, making the first loop go over the hook, and passing the portion extending from the first loop into the first loop to make a second loop;

the passing step includes advancing the latch needle to move the second loop over the latch toward the stem of the latch needle, bringing the second thread with a beginning end thereof being held to the hook, and making the second loop go over the hook to insert the second thread into the second loop; and the pulling step includes reducing the second loop and the first loop until the beginning end of the second thread is stopped into the first loop.

3. The method according to claim 1, further comprising the steps of:

cutting the first thread to make the tail end portion; and holding the tail end portion made by the cutting step for preparing the first thread for the making the first loop step.

4. A thread tying apparatus, comprising:

a first thread holding member that holds a tail end portion of a first thread;

a latch needle having a hook at a tip thereof and a latch whose root is pivotally mounted to a stem thereof so as to open and close the latch with respect to the hook;

a first loop controller that slidably makes contact with the stem of the latch needle and moves in a direction of an axis of the latch needle;

a second thread holding member that holds a beginning end of a second thread and changes a position of the beginning end of the second thread so as to be close to the hook of the latch needle; and an interlock mechanism that performs the following steps:

rotating the latch needle on the axis thereof to make a first loop at the hook by winding the first thread substantially around the hook;

advancing the latch needle to place the first loop over the latch of the latch needle, which is away from the hook, on the stem of the latch needle and to place a portion extending from the first loop of the first thread inside the latch;

moving the first loop controller and the latch needle relative to each other to make the first loop go over the hook, pass the portion extending from the first loop through the first loop to make a second loop at the hook, and make the second loop go over the latch to move the second loop toward the stem of the latch needle;

bringing the second thread whose beginning end is held at the second thread holding member to the hook;

operating the latch needle and the first loop controller together to move the second loop away from the hook and insert the second thread into the second loop; and reducing the second loop and the first loop until the beginning end of the second thread is stopped into the first loop.

5. The thread tying apparatus according to claim 4, further comprising a magnet so as to separate the latch from the hook only when the latch needle comes to a rotated position.

6. The thread tying apparatus according to claim 5, wherein the latch is made of magnetic material so as to open away from the hook when it comes to the rotated position.

7. The thread tying apparatus according to claim 5, wherein when the interlock mechanism disposes a portion extending to the first loop of the first thread inside the latch which is open, places the latch away from the an intersecting portion of the first loop, moves the latch needle backward with the latch being kept open by a latch regulating member until a tip of the latch passes the portion extending to the first loop, and rotates the latch needle so that the latch comes close to the intersecting portion of the first loop.

8. The thread tying apparatus according to claim 4, wherein a guiding groove is formed on the stem of the latch needle along the axis of the latch needle so that a tip of the first loop controller that moves forward along the guiding groove goes into the first loop.

9. The thread tying apparatus according to claim 4, further comprising a thread volume controller that secures a thread length required for forming the first loop and the second loop from the first thread and that pulls a midpoint of the first thread to reduce a diameter of the second loop formed at the hook.

10. The thread tying apparatus according to claim 4, wherein the interlock mechanism activates the first thread holding member and the second thread holding member so as to hold and release each end portion of the first thread and the second thread, and the interlock mechanism controls the first thread holding member, the second thread holding member, and the hook such that a relative position between the first thread holding member and the hook is selectively changed between a position where the first thread is supplied and a position where the first thread is not supplied, and such that a relative position between the second thread holding member and the hook is selectively changed between a position where the second thread is supplied and a position where the second thread is not supplied.

11. The thread tying apparatus according to claim 4, wherein the interlock mechanism activates the second thread holding member so as to place the second thread within a path where the latch is rotated before the second loop is moved away from the latch toward the stem of the latch needle.

12. The thread tying apparatus according to claim 4, wherein the interlock mechanism performs the following steps:

advancing the latch needle to move the second loop over the latch toward the stem of the latch needle;

making the hook catch the second thread whose beginning end is held at the second thread holding member;

moving the latch needle backward to close the latch by the second loop;

releasing the beginning of the second thread from the second thread holding member;

inserting the second thread into the second loop coming off the hook; and reducing the second loop and the first loop until the beginning end of the second thread is stopped into the first loop, to tie the first thread and the second thread.

13. The thread tying apparatus according to claim 4, wherein the beginning end of the second thread is inserted into the second loop coming off the latch needle and held by the second thread pressing device.

14. The thread tying apparatus according to claim 5, wherein the first thread holding member comprises a pair of outside plates, and an inner plate, which is capable of entering between the pair of outside plates, the pair of outside plates and the inner plate are structured to hold the first thread firmly therebetween, a cutter is disposed which slidably makes contact with one of the pair of outside plates, and the one of the pair of outside plates includes a control part that prevents displacement of the first thread.

* * * * *